US009460825B2

(12) United States Patent
Kuwagaki

(10) Patent No.: US 9,460,825 B2
(45) **Date of Patent: *Oct. 4, 2016**

(54) CU-CO-SI-BASED COPPER ALLOY FOR ELECTRONIC MATERIALS, AND METHOD OF MANUFACTURING SAME

(75) Inventor: Hiroshi Kuwagaki, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/701,267

(22) PCT Filed: Apr. 8, 2011

(86) PCT No.: PCT/JP2011/058923

§ 371 (c)(1),
(2), (4) Date: Nov. 30, 2012

(87) PCT Pub. No.: WO2011/152124

PCT Pub. Date: Dec. 8, 2011

(65) Prior Publication Data

US 2013/0087255 A1 Apr. 11, 2013

(30) Foreign Application Priority Data

May 31, 2010 (JP) ..... 2010-125338

(51) Int. Cl.
*C22F 1/08* (2006.01)
*C22C 9/02* (2006.01)
(Continued)

(52) U.S. Cl.
CPC ..... *H01B 1/026* (2013.01); *C22C 9/01* (2013.01); *C22C 9/02* (2013.01); *C22C 9/04* (2013.01);
(Continued)

(58) Field of Classification Search
CPC ..... C22C 9/06; C22C 9/10; C22C 9/01; C22C 9/02; C22C 9/04; C22C 9/05; C22F 1/00; C22F 1/08
USPC ..... 148/682, 683, 684, 685, 686, 433, 554
See application file for complete search history.

(56) References Cited

U.S. PATENT DOCUMENTS

2004/0079456 A1 4/2004 Mandigo et al.
2004/0166017 A1* 8/2004 Caron et al. ..... 420/492
(Continued)

FOREIGN PATENT DOCUMENTS

EP 1873266 A1 1/2008
JP 09-020943 A 1/1997
(Continued)

OTHER PUBLICATIONS

Supplementary European Search Report dated Mar. 11, 2014 in European Application No. 11789534.
(Continued)

*Primary Examiner* — Alexander Polyansky
(74) *Attorney, Agent, or Firm* — Drinker Biddle & Reath LLP

(57) ABSTRACT

Disclosed is a Cu—Co—Si-based copper alloy for electronic materials, which is capable of achieving high levels of strength, electrical conductivity, and also anti-setting property; and contains 0.5 to 3.0% by mass of Co, 0.1 to 1.0% by mass of Si, and the balance of Cu and inevitable impurities; wherein out of second phase particles precipitated in the matrix a number density of the particles having particle size of 5 nm or larger and 50 nm or smaller is $1\times10^{12}$ to $1\times10^{14}$ particles/mm$^3$, and a ratio of the number density of particles having particle size of 5 nm or larger and smaller than 10 nm relative to the number density of particles having particle size of 10 nm or larger and 50 nm or smaller is 3 to 6.

10 Claims, 1 Drawing Sheet

(51) Int. Cl.

| | |
|---|---|
| ***H01B 1/02*** | (2006.01) |
| ***C22C 9/06*** | (2006.01) |
| ***C22C 9/10*** | (2006.01) |
| ***C22F 1/00*** | (2006.01) |
| ***C22C 9/01*** | (2006.01) |
| ***C22C 9/04*** | (2006.01) |
| ***C22C 9/05*** | (2006.01) |
| *C22F 1/04* | (2006.01) |

(52) U.S. Cl.
CPC . *C22C 9/05* (2013.01); *C22C 9/06* (2013.01); *C22C 9/10* (2013.01); *C22F 1/00* (2013.01); *C22F 1/08* (2013.01)

(56) References Cited

U.S. PATENT DOCUMENTS

| | | | |
|---|---|---|---|
| 2006/0137773 | A1 | 6/2006 | Aruga et al. |
| 2008/0047634 | A1 | 2/2008 | Mihara et al. |
| 2008/0056930 | A1 | 3/2008 | Ito et al. |
| 2009/0035174 | A1 | 2/2009 | Era et al. |
| 2009/0257909 | A1 | 10/2009 | Mihara et al. |
| 2010/0193092 | A1 | 8/2010 | Matsuo et al. |
| 2010/0326573 | A1 | 12/2010 | Mihara et al. |
| 2011/0005644 | A1 | 1/2011 | Matsuo et al. |
| 2011/0186192 | A1 | 8/2011 | Mihara et al. |
| 2011/0200480 | A1 | 8/2011 | Matsuo et al. |
| 2011/0244260 | A1 | 10/2011 | Kuwagaki |
| 2013/0087255 | A1 | 4/2013 | Kuwagaki |

FOREIGN PATENT DOCUMENTS

| | | | |
|---|---|---|---|
| JP | 10-219374 | A | 8/1998 |
| JP | 2005532477 | A | 10/2005 |
| JP | 2006200036 | | 3/2006 |
| JP | 2006265731 | A | 10/2006 |
| JP | 2007-169765 | A | 7/2007 |
| JP | 2007169764 | A | 7/2007 |
| JP | 2007169765 | A | 7/2007 |
| JP | 2007169781 | A | 7/2007 |
| JP | 2008-056977 | A | 3/2008 |
| JP | 2008-56977 | A | 3/2008 |
| JP | 2008056977 | A | 3/2008 |
| JP | 2008-248333 | A | 10/2008 |
| JP | 2009-242814 | A | 10/2009 |
| JP | 2009-242890 | A | 10/2009 |
| JP | 2009-242926 | A | 10/2009 |
| WO | 2004005560 | A2 | 1/2004 |
| WO | 2006101172 | A1 | 9/2006 |
| WO | 2008032738 | A1 | 3/2008 |
| WO | 2009096546 | A1 | 8/2009 |
| WO | WO 2009/096546 | A1 | 8/2009 |
| WO | 2009116649 | A1 | 9/2009 |
| WO | WO 2009/116649 | A1 | 9/2009 |
| WO | 2010013790 | A1 | 2/2010 |
| WO | 2010016428 | A1 | 2/2010 |
| WO | WO 2010/013790 | A1 | 2/2010 |
| WO | 2010064547 | A1 | 6/2010 |

OTHER PUBLICATIONS

Office Action dated Nov. 17, 2014 for U.S. Appl. No. 13/818,455.
Office Action dated Apr. 24, 2014 for U.S. Appl. No. 13/131,718.
Office Action dated Dec. 4, 2014 for U.S. Appl. No. 13/131,718.
Office Action dated Apr. 22, 2015 for U.S. Appl. No. 13/131,718.

* cited by examiner

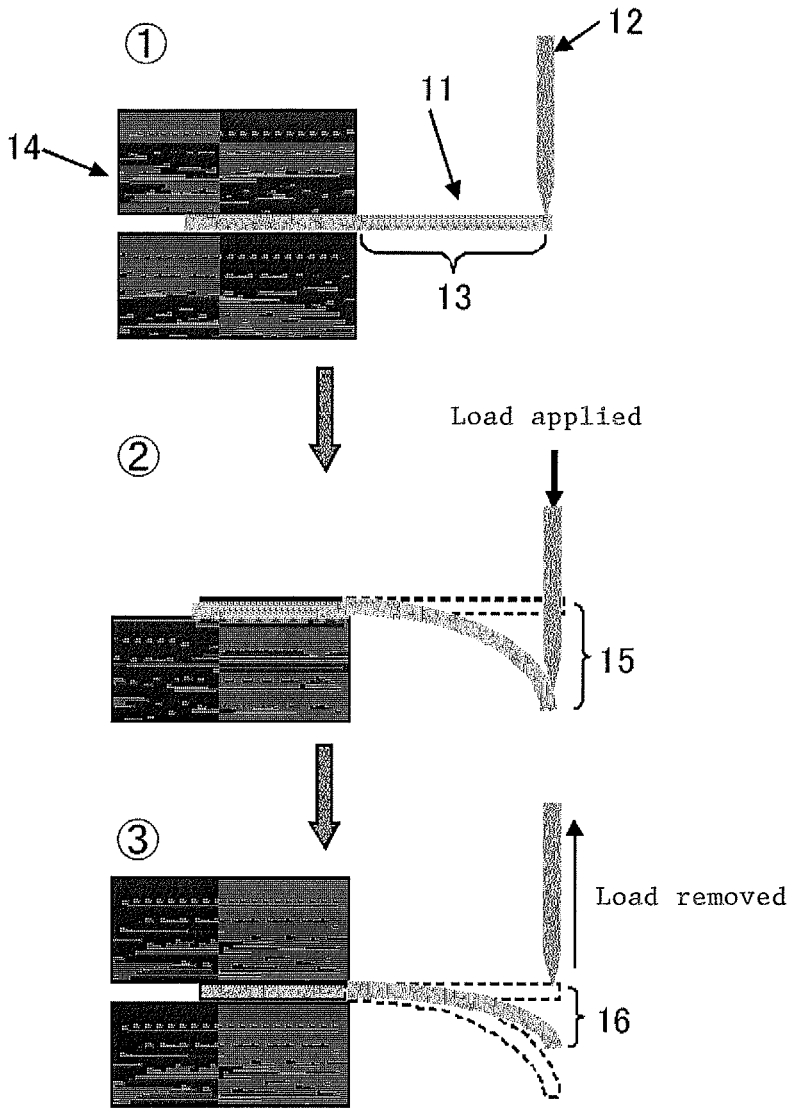
①
12
11
14
13
Load applied
②
15
③
Load removed
16

CU-CO-SI-BASED COPPER ALLOY FOR ELECTRONIC MATERIALS, AND METHOD OF MANUFACTURING SAME

TECHNICAL FIELD

The present invention relates to a precipitation hardening copper alloy, and in particular to a Cu—Co—Si-based copper alloy suitably adoptable to various electronic components.

BACKGROUND ART

Copper alloy for electronic materials used for various electronic components such as connector, switch, relay, pin, terminal, lead frame and so forth are required to satisfy both of high strength and high electrical conductivity (or heat conductivity) as basic characteristics. In recent years, with rapid progress in higher integration, miniaturization and thinning of the electronic components, requirements for the copper alloy used for the components for electronic instruments have been growing more and more severe.

In consideration of high strength and high electrical conductivity of copper alloys for electronic materials, the use of precipitation hardening copper alloys has increased, in place of traditional solid solution strengthened copper alloys such as phosphor bronze and brass. In the precipitation hardening copper alloys, age hardening of supersaturated solid solution after solution treatment facilitates uniform dispersion of fine precipitates and thus an increase in strength of the alloys. It also leads to a decrease in amount of solute elements in copper matrix and thus an improvement in electrical conductivity. The resulting materials have superior mechanical properties such as strength and spring properties, as well as high electrical and thermal conductivities.

Among precipitation hardening copper alloys, Cu—Ni—Si-based copper alloy generally called "Corson-based alloy" is a representative copper alloy having all of relatively high electrical conductivity, strength, and bendability, and is one of the alloys having been developed vigorously in the related industry. The strength and electrical conductivity of this copper alloy can be improved, by allowing fine particles of Ni—Si-based intermetallic compound to precipitate in a copper matrix.

A Cu—Ni—Si-based alloy generally called Corson-based copper alloy has conventionally been known as a representative copper alloy having all of relatively high electrical conductivity, strength and bendability. The strength and electrical conductivity of this copper alloy may be improved, by allowing fine particles of Ni—Si-based intermetallic compound to precipitate in a copper matrix. It is, however, difficult for the Cu—Ni—Si-based alloy to achieve an electrical conductivity of 60% IACS or higher, while keeping high strength. For this reason, Cu—Co—Si-based alloy now attracts attention. The Cu—Co—Si-based alloy is advantageous in that electrical conductivity may be grown higher than that of the Cu—Ni—Si-based copper alloy, by virtue of its lower solute content of cobalt silicide ($Co_2Si$).

Processes largely influential to characteristics of the Cu—Co—Si-based copper alloy are exemplified by solution treatment, ageing, and final rolling. Among others, ageing is one of the processes most influential to distribution and particle size of precipitates of cobalt silicide.

Patent Document 1 (Japanese Laid-Open Patent Publication No. 2008-56977) describes Cu—Co—Si-based alloy examined with respect to not only copper alloy composition, but also particle size and total amount of inclusion which precipitates in the copper alloy, wherein the alloy is aged, after solution treatment, at 400° C. or above and 600° C. or below for 2 hours or longer and 8 hours or shorter. According to the document, the particle size of inclusion precipitated in the copper alloy is reportedly adjusted to 2 μm or smaller, and the content of the inclusion of 0.05 μm or larger and 2 μm or smaller in the copper alloy is adjusted to 0.5% by volume or below.

Patent Document 2 (Japanese Laid-Open Patent Publication No. 2009-242814) exemplifies a Cu—Co—Si-based alloy as a precipitation hardening copper alloy capable of achieving an electrical conductivity of as high as 50% IACS or more which is not readily achievable by the Cu—Ni—Si-based alloy. The document describes the ageing proceeded at 400 to 800° C. for 5 seconds to 20 hours. The document also specifies state of diffusion of the second phase, from the viewpoint of controlling crystal grain size, specifically describing that the second phase particles reside on grain boundary at a density of $10^4$ to $10^8$ particles/mm$^2$, and that r/f value of 1 to 100, wherein the r/f value is defined as a ratio of diameter r (in μm) of all second phase particles which reside in the crystal grains and on the grain boundary, to volume fraction f of the particles.

Patent Document 3 (WO2009-096546) describes a Cu—Co—Si-based alloy characterized in that the size of precipitate, containing both of Co and Si, is 5 to 50 nm. According to the description, ageing after solution treatment for recrystallization is preferably proceeded at 450 to 600° C. for 1 to 4 hours.

Patent Document 4 (WO2009-116649) describes a Cu—Co—Si-based alloy having excellent strength, electrical conductivity, and bendability. According to Examples described in the document, the ageing is proceeded at 525° C. for 120 minutes, rate of heating from room temperature up to the maximum temperature falls in the range from 3 to 25° C./min, and rate of cooling in a furnace down to 300° C. falls in the range from 1 to 2° C./min.

RELATED DOCUMENT

Patent Document

[Patent Document 1]
Japanese Laid-Open Patent Publication No. 2008-56977
[Patent Document 2]
Japanese Laid-Open Patent Publication No. 2009-242814
[Patent Document 3]
International Patent WO2009/096546 pamphlet
[Patent Document 4]
International Patent WO2009/116649 pamphlet

DISCLOSURE OF THE INVENTION

Problems to be Solved by the Invention

Despite various improvements having been made on the characteristics, the Cu—Co—Si-based alloy still has room for further improvement. In particular, anti-setting property against permanent deformation, which possibly occurs when the alloy is used as a spring material, has not been satisfactory. While WO2009-096546 describes control of the size of second phase particles contributive to the strength and so forth, the document only shows results observed at a 100,000× magnification, based on which it is difficult to precisely measure the size of fine precipitates of 10 nm or smaller. While WO2009-096546, again, describes that the particle size of precipitate was 5 to 50 nm, all average particle sizes described in Examples fall in the range of 10 nm or larger. In short, there is still room for improvement of the state of precipitation of second phase particles represented by cobalt silicide.

It is therefore supposed that improvement in the anti-setting property will be advantageous, since improvement in the anti-setting property will result in improvement in the reliability as a spring material. It is therefore an object of the present invention to provide a Cu—Co—Si-based copper alloy capable of achieving high strength, electrical conductivity and preferably bendability, and also achieving excellent anti-setting property. It is another object of the present invention to provide a method of manufacturing such Cu—Co—Si-based alloy.

Means for Solving the Problems

The present inventors went through extensive investigations aimed at solving the above-described problems, and found out from observation of structure of a Cu—Co—Si-based alloy that it is important to appropriately control the state of distribution of very fine second phase particles of 50 nm or smaller, which were found to strongly affect improvement in the strength, electrical conductivity and anti-setting property. More specifically, the second phase particles having particle sizes in the range from 5 nm or larger and smaller than 10 nm were found to improve the strength and the initial anti-setting property, whereas those having particle sizes in the range from 10 nm or larger and 50 nm or smaller were found to improve the repetitive anti-setting property, so that the strength and the anti-setting property may be improved in a well-balanced manner, by controlling the number density and ratio of these ranges of particles.

According to one aspect of the present invention accomplished based on the above-described findings, there is provided a copper alloy for electronic materials which contains 0.5 to 3.0% by mass of Co, 0.1 to 1.0% by mass of Si, and the balance of Cu and inevitable impurities, wherein out of second phase particles precipitated in the matrix a number density of the particles having particle size of 5 nm or larger and 50 nm or smaller is $1\times10^{12}$ to $1\times10^{14}$ particles/$mm^3$, and a ratio of the number density of particles having particle size of 5 nm or larger and smaller than 10 nm relative to the number density of particles having particle size of 10 nm or larger and 50 nm or smaller is 3 to 6.

In one embodiment of the copper alloy of the present invention, the number density of second phase particles having particle sizes of 5 nm or larger and smaller than 10 nm is $2\times10^{12}$ to $7\times10^{13}$, and the number density of second phase particles having particle sizes of 10 nm or larger and 50 nm or smaller is $3\times10^{11}$ to $2\times10^{13}$.

In another embodiment, the copper alloy has an MBR/t value of 2.0 or smaller, where the value is defined by a ratio of minimum bend radius (MBR) not causative of crack to thickness of specimen (t) when tested by W-bend test in the bad-way direction, in accordance with JIS H3130.

In still another embodiment, the copper alloy of the present invention further contains a maximum of 2.5% by mass of Ni.

In still another embodiment, the copper alloy of the present invention further contains a maximum of 0.5% by mass of Cr.

In still another embodiment, the copper alloy of the present invention further contains a maximum of 2.0% by mass in total of one or more selected from the group consisting of Mg, P, As, Sb, Be, B, Mn, Sn, Ti, Zr, Al, Fe, Zn and Ag.

According to another aspect of the present invention, there is provided a method of manufacturing a copper alloy for electronic materials, which includes the sequential steps of:

- process 1 for melting, casting of an ingot represented by any one composition described in the above;
- process 2 for heating the material at 950° C. or above and 1050° C. or below for one hour or more, followed by hot rolling;
- process 3 for optional cold rolling;
- process 4 for solution treatment proceeded by heating the material at 850° C. or above and 1050° C. or below;
- process 5 for first ageing proceeded by heating the material at 400° C. or above and 600° C. or below for 1 to 12 hours, where the temperature is adjusted to 400° C. or above and 500° C. or below for an ingot containing 1.0 to 2.5% by mass of Ni;
- process 6 for cold rolling proceeded at a rolling reduction of 10% or more; and
- process 7 for second ageing proceed by heating the material at 300° C. or above and 400° C. or below for 3 to 36 hours, the time of heating herein being 3 to 10 times as long as that in the first ageing.

In one embodiment of the method of manufacturing a copper alloy of the present invention, the rolling reduction in process 6 for cold rolling is 10 to 50%.

According to still another aspect of the present invention, there is provided a wrought copper product made of the copper alloy of the present invention.

According to still another aspect of the present invention, there is provided an electronic component having the copper alloy of the present invention.

Effect of the Invention

According to the present invention, a Cu—Co—Si-based copper alloy well-balanced among strength, electrical conductivity and anti-setting property may be obtained. According to more preferable embodiment, a Cu—Co—Si-based copper alloy also excelled in the bendability may be obtained.

BRIEF DESCRIPTION OF THE DRAWING

FIG. 1 is a drawing for explaining anti-setting property test.

DESCRIPTION OF THE EMBODIMENTS

Amounts of Addition of Co and Si

In one embodiment, the Cu—Co—Si-based alloy of the present invention contains 0.5 to 3.0% by mass of Co, 0.1 to 1.0% by mass of Si, and the balance of Cu and inevitable impurities.

Co and Si form an intermetallic compound under appropriate heating, to thereby successfully improve the strength without degrading the electrical conductivity.

The amounts of addition of less than 0.5% by mass for Co and less than 0.1% by mass for Si may fail in achieving a desired level of strength. The amounts of addition exceeding 3.0% by mass for Co and exceeding 1.0% by mass for Si may improve the strength, but may considerably degrade the electrical conductivity, and may further degrade the hot workability. The amounts of addition of Co and Si are, therefore, determined to be 0.5 to 3.0% by mass for Co, and 0.1 to 1.0% by mass for Si. The amounts of addition are preferably 0.5 to 2.0% by mass for Co, and 0.1 to 0.5% by mass for Si.

Amount of Addition of Ni

Also Ni forms an intermetallic compound with Si, similarly to Co, and successfully improves the strength without degrading the electrical conductivity, although the degree of which is not so large as Co does. The Cu—Co—Si-based alloy of the present invention may, therefore, be added with Ni. Excessive addition may, however, considerably degrade the electrical conductivity similarly to excessive addition of Co. The amount of addition of Ni is, therefore, necessarily limited to 2.5% by mass or below, preferably 2.2% by mass or below, and more preferably 2.0% by mass or below.

When Ni is not added, composition of cobalt silicide, which forms the second phase particles contributive to improvement in the strength, is given as $Co_2Si$, so that the characteristics may most efficiently be improved when the ratio by mass of Co and Si (Co/Si) is 4.2. The ratio by mass of Co and Si, far away from the value, means excess of either element, wherein the excessive element is not adequate since it is not only less contributive to improvement in the strength, but also causative of degradation in the electrical conductivity. The ratio by mass of Co and Si in percentage is preferably adjusted to $3.5 \leq Co/Si \leq 5.5$, and more preferably to $4 \leq Co/Si \leq 5$. On the other hand, when Ni is added, based on the same reason, the ratio by mass of (Co+Ni) and Si in percentage is preferably adjusted to $3.5 \leq [Ni+Co]/Si \leq 5.5$, and more preferably to $4 \leq [Ni+Co]/Si \leq 5$.

Amount of Addition of Cr

Cr predominantly precipitates in the process of cooling in casting, so as to reinforce the grain boundary, to suppress cracking during hot working, and to thereby suppress degradation in yield ratio. More specifically, Cr precipitated in the grain boundary in the process of casting, which solves in the process of solution treatment, forms bcc-structured precipitated particles mainly composed of Cr or a compound formed together with Si in the succeeding precipitation process. In the general Cu—Ni—Si-based alloy, a portion of Si not contributive to the precipitation, out of the total Si, remains solved in the matrix and suppresses elevation of the electrical conductivity, whereas addition of Cr as a silicide forming element, aiming at further promoting precipitation of silicide, may successfully reduce the amount of solved Si, and may thereby elevate the electrical conductivity without degrading the strength. However, the concentration of Cr exceeding 0.5% by mass will impair characteristics of the product, since coarse second phase particles will more readily be formed. For this reason, the Cu—Co—Si-based alloy of the present invention may be added with a maximum of 0.5% by mass of Cr. The amount of addition smaller than 0.03% by mass will, however, give only a limited effect, so that it is preferably 0.03 to 0.5% by mass, and more preferably 0.09 to 0.3% by mass.

Amounts of Addition of Mg, Mn, Ag and P

Mg, Mn, Ag and P can improve characteristics of the product, such as strength and stress relaxation characteristics, only by trace amounts of addition, without degrading the electrical conductivity. While the effect of addition may be expressed typically as a result of solid solution into the matrix, a larger effect may be expressed by allowing them to be included in the second phase particles. However, the effect of improving the characteristics saturates and degrades the manufacturability, if the total concentration of Mg, Mn, Ag and P exceeds 2.0% by mass. It is, therefore, preferable to add a maximum of 2.0% by mass in total of one or more selected from the group consisting of Mg, Mn, Ag and P, to the Cu—Co—Si-based alloy of the present invention. The amounts of addition smaller than 0.01% by mass will, however, give only a limited effect, so that it is preferably 0.01 to 2.0% by mass in total, more preferably 0.02 to 0.5% by mass in total, and typically 0.04 to 0.2% by mass in total.

Amounts of Addition of Sn and Zn

Also Sn and Zn can improve the characteristics of the product, such as strength, stress relaxation characteristics, and platability, only by trace amounts of addition, without degrading the electrical conductivity. The effect of addition may be expressed typically as a result of solid solution into the matrix. However, the effect of improving the characteristics saturates and degrades the manufacturability, if the total concentration of Sn and Zn exceeds 2.0% by mass. It is, therefore, preferable to add a maximum of 2.0% by mass of either one of, or both in total of Sn and Zn, to the Cu—Co—Si-based alloy of the present invention. The amounts of addition smaller than 0.05% by mass will, however, give only a limited effect, so that it is preferably 0.05 to 2.0% by mass in total, and more preferably 0.5 to 1.0% by mass in total.

Amounts of Addition of As, Sb, Be, B, Ti, Zr, Al and Fe

Also As, Sb, Be, B, Ti, Zr, Al and Fe can improve the characteristics of the product, such as electrical conductivity, strength, stress relaxation characteristics, platability and so forth, if the amounts of addition thereof are appropriately adjusted depending on required characteristics. While the effect of addition may be expressed typically as a result of solid solution into the matrix, a larger effect may be expressed by allowing them to be included in the second phase particles, or by formation of second phase particles of new composition. However, the effect of improving the characteristics saturates and degrades the manufacturability, if the total concentration of these elements exceeds 2.0% by mass. It is, therefore, preferable to add a maximum of 2.0% by mass in total of one or more selected from the group consisting of As, Sb, Be, B, Ti, Zr, Al and Fe, to the Cu—Co—Si-based alloy of the present invention. The amounts of addition smaller than 0.001% by mass will, however, give only a limited effect, so that it is preferably 0.001 to 2.0% by mass in total, and more preferably 0.05 to 1.0% by mass in total.

Since the amounts of addition of the above-described Mg, P, As, Sb, Be, B, Mn, Sn, Ti, Zr, Al, Fe, Zn and Ag exceeding 2.0% by mass in total may tend to degrade the manufacturability, so that the total amount is preferably 2.0% by mass or below, more preferably 1.5% by mass or below, and still more preferably 1.0% by mass or below.

Conditions for Distribution of Second Phase Particles

In the present invention, the second phase particles typically refer to silicide particles, but not limited thereto. They also refer to crystallized matter produced in the process of solidification in casting, precipitates produced in the succeeding cooling process, precipitates produced in the process of cooling after hot rolling, precipitates produced in the process of cooling after solution treatment, and precipitates produced in the process of ageing.

General Corson alloy is known to be improved in the strength, without being degraded in the electrical conductivity, by appropriate ageing which allows precipitation of fine second phase particles on the order of nanometer (generally smaller than 0.1 μm) mainly composed of an intermetallic compound. However, it has not been known that such fine second phase particles may further be divided into those in a particle size range more contributive to the strength, and those in a particle size range more contributive to the anti-setting property, and that the strength and the anti-setting property may further be improved in a well-balanced manner, by appropriately controlling the state of precipitation of these particles.

The present inventors found out that number density of very fine second phase particles having particle sizes of 50 nm or smaller strongly affects improvement in the strength, electrical conductivity and anti-setting property. The present inventors further found out that the second phase particles having particle sizes in the range from 5 nm or larger and smaller than 10 nm contribute to improve the strength and the initial anti-setting property, whereas those having particle sizes in the range from 10 nm or larger and 50 nm or smaller contribute to improve the repetitive anti-setting property, and that the strength and the anti-setting property may be improved in a well-balanced manner, by controlling the number density and ratio of these ranges of particles.

Specifically, it is important to adjust the number density of second phase particles having particle sizes of 5 nm or larger and 50 nm or smaller to $1\times10^{12}$ to $1\times10^{14}$ particles/$mm^3$, more preferably to $5\times10^{12}$ to $5\times10^{13}$ particles/$mm^3$. The number density of second phase particles smaller than $1\times10^{12}$ particles/$mm^3$ yields almost no benefit of precipitation hardening, consequently fails in obtaining desired levels of strength and electrical conductivity, and also degrades the anti-setting property. On the other hand, the characteristics are supposed to be improved by increasing, as possible in practice, the number density of the second phase particles in this range. A trial of promoting precipitation of the second phase particles, aimed at increasing the number density, however tends to coarsen the second phase particles, so that it is difficult to achieve the number density exceeding $1\times10^{14}$ particles/$mm^3$.

In addition, for the purpose of improving the strength and the anti-setting property in a well-balanced manner, it is necessary to control the ratio of the number density of second phase particles having particle sizes of 5 nm or larger and smaller than 10 nm which are more contributive to improvement in the strength, and the number density of second phase particles having particle sizes of 10 nm or larger and 50 nm or smaller more contributive to improvement in the anti-setting property. More specifically, the ratio of the number density of second phase particles having particle sizes of 5 nm or larger and smaller than 10 nm, relative to the number density of second phase particles having particle sizes of 10 nm or larger and 50 nm or smaller, is adjusted to 3 to 6. If the ratio is smaller than 3, the ratio of second phase particles contributive to the strength will be too small, the balance between the strength and the anti-setting property will degrade, the strength will degrade as a consequence, and also the initial anti-setting property will degrade. On the other hand, if the ratio is larger than 6, the ratio of second phase particles contributive to the anti-setting property will be too small, the balance between the strength and the anti-setting property will again degrade, and the repetitive anti-setting property will degrade as a consequence.

In one preferable embodiment, the number density of second phase particles having particle sizes of 5 nm or larger and smaller than 10 nm is $2\times10^{12}$ to $7\times10^{13}$ particles/$mm^3$, and the number density of second phase particles having particle sizes of 10 nm or larger and 50 nm or smaller is $3\times10^{11}$ to $2\times10^{13}$ particles/$mm^3$.

While strength is also affected by the number density of second phase particles having particle sizes exceeding 50 nm, the number density of second phase particles having particle sizes exceeding 50 nm will naturally fall in an appropriate range, by controlling the number density of second phase particles having particle sizes of 5 nm or larger and 50 nm or smaller as described in the above.

In one preferable embodiment, the copper alloy of the present invention has an MBR/t value of 2.0 or smaller, wherein the value is defined by a ratio of minimum bend radius (MBR) not causative of crack to thickness of specimen (t) when tested by W-bend test in the bad-way direction, in accordance with JIS H3130. The MBR/t value is typically adjustable in the range from 1.0 to 2.0.

Method of Manufacturing

In general manufacturing process of Corson-based copper alloy, first, raw materials such as electrolytic copper, Ni, Si, Co and so forth are melted in an atmospheric melting furnace, so as to obtain a molten metal having a desired composition. The molten metal is then cast into an ingot. The ingot is then subjected to hot rolling, and then to cold rolling repeated alternately with heating, so as to obtain a strip or foil having a desired thickness and characteristics. The heating includes solution treatment and ageing. In the solution treatment, the work is heated at high temperatures of approx. 700 to 1000° C., so as to allow the second phase particles to solve into the Cu matrix, and at the same time, the Cu matrix is allowed to re-crystallize. The solution treatment may serve as hot rolling. In the ageing, the work is heated in the temperature range approximately from 350 to 550° C. for one hour or longer, so as to precipitate the second phase particles, having been solved by the solution treatment, in the form of fine particles on the order of nanometer. The strength and the electrical conductivity may be enhanced by the ageing. In order to obtain still higher strength, cold rolling may precede and/or succeed the ageing. For the case where the ageing is followed by cold rolling, the cold rolling may further be followed by stress relief annealing (low temperature annealing).

Between each of the processes described in the above, grinding, polishing, shot blasting, acid pickling and so forth may be carried out as required, in order to remove oxide scale formed on the surface.

Also the copper alloy of the present invention basically goes through the above-described manufacturing processes, wherein it is important to precisely control conditions for hot rolling, solution treatment and ageing, in order to adjust the distribution form of the second phase particles as specified by the present invention in the finally-obtained copper alloy. This is because, the Cu—Co—Si-based alloy of the present invention is intentionally added with Co (occasionally together with Cr), which tends to coarsen the second phase particles, as an essential component for age/precipitation hardening, unlike the conventional Cu—Ni—Si-based Corson alloy. This is because the rate of generation and growth of the second phase particles, formed by the thus-added Co together with Ni and Si, is sensitive to holding temperature in the heating, and cooling speed.

Coarse crystallized matter inevitably generates in the process of solidification in the casting, and coarse precipitate inevitably generates in the process of cooling process. It is therefore necessary in the succeeding process to solve these second phase particles into the matrix. The second phase particles may be solved into the matrix, even if added with Co, and additionally added with Cr, if hot rolling is carried out after being held at 950° C. to 1050° C. for one hour or longer, and the temperature at the end of hot rolling is 850° C. or above. The temperature condition of 950° C. or above is higher than that for the case of other Corson-based alloys. The holding temperature before hot rolling of lower than 950° C. may result in insufficient solid solution, and the holding temperature exceeding 1050° C. may melt the material. The temperature at the end of hot rolling of lower than 850° C. may allow the solved elements to re-precipitate, making it difficult to achieve high strength. It is therefore preferable to terminate the hot rolling at 850° C. and to quickly quench the work thereafter, for the purpose of achieving high strength. The quenching is achievable by water cooling.

Solution treatment is aimed at promoting solid solution of crystallized particles produced during the casting, or precipitated particles produced after hot rolling, so as to enhance age hardening performance after the solution treatment. In view of controlling the number density of second phase particles, important factors herein include the holding temperature and holding time during the solution treatment. Given the holding time is kept constant, particles crystallized during the casting, and particles precipitated after the hot rolling may be solved by elevating the holding temperature, and thereby area ratio may be reduced. More specifically, the temperature of solution treatment lower than 850° C. will allow solid solution to proceed only insufficiently, and will fail in achieving a desired level of strength, whereas the temperature of solution treatment exceeding 1050° C. will cause melting of the material. Therefore, the solution treatment is preferably proceeded while heating the material at 850° C. or above and 1050° C. or below, more preferably at 900° C. or above and 1020° C. or below. Time of solution treatment is preferably adjusted to 60 seconds to 1 hour. Cooling after the solution treatment is preferably proceeded with rapid cooling, so as to prevent the solved second phase particles from re-precipitating.

In manufacturing of the Cu—Co—Si-based alloy of the present invention, the solution treatment is preferably followed by moderate ageing treatment repeated twice, while placing cold rolling in between. In this way, the precipitated matters may be prevented from growing larger, and thereby the state of distribution of the second phase particles specified by the present invention may be obtained.

In the first ageing, the temperature is set slightly lower than that generally believed to be effective to miniaturize the precipitated matter, so as to prevent the precipitated matter possibly produced in the solution treatment from growing larger, while promoting precipitation of the fine second phase particles. The first ageing proceeded at the temperature lower than 400° C. will tend to lower the density of the second phase particles having particle sizes 10 nm to 50 nm which are contributive to improvement in the repetitive anti-setting property, whereas the first ageing proceeded at the temperature exceeding 500° C. will result in over-ageing, and will tend to lower the density of second phase particles having particle sizes of 5 nm to 10 nm which are contributive to the strength and the initial anti-setting property. Therefore, the first ageing is preferably proceeded in the temperature range from 400° C. or above to 600° C. or below, for 1 to 12 hours. Preferable temperature for ageing may, however, vary depending on Ni content in the alloy. The Cu—Co—Si-based alloy and Cu—Co—Ni—Si-based alloy show different ways of precipitation of the second phase particles, because the temperature at which the strength of Cu—Co—Si alloy is maximized shifts higher than that of Cu—Co—Ni—Si alloy. More specifically, the material is preferably heated at 400° C. or above and 500° C. or below for 3 to 9 hours if the Ni content is 1.0 to 2.5% by mass, whereas the material is preferably heated at 450° C. or above and 550° C. or below for 3 to 9 hours if the Ni content is smaller than 1.0% by mass.

The first ageing is followed by cold rolling. In the cold rolling, insufficient age hardening in the first ageing may be supplemented by work hardening. The rolling reduction of smaller than 10% will cause only a small population of strains which act as sites of precipitation, so that the second phase particles will become less likely to precipitate in a uniform manner in the second ageing. The rolling reduction of cold rolling exceeding 50% will tend to degrade the bendability. This will also cause resolution of the second phase particles precipitated in the first ageing. The rolling reduction of cold rolling after the first ageing is preferably adjusted to 10 to 50%, and more preferably 15 to 40%. Note that the rolling reduction is preferably adjusted to 30% or larger if the Ni content is 1.0 to 2.5% by mass, since a too small rolling reduction will tend to reduce the rate of second phase particles having particle sizes of 5 nm or larger and less than 20 nm.

The second ageing is aimed at allowing second phase particles, finer than those precipitated in the first ageing, to newly precipitate, without causing as possible growth of the second phase particles having been precipitated in the first ageing. Too high second ageing temperature will cause excessive growth of the second phase particles having previously been precipitated, so that the number density of second phase particles intended by the present invention will not be obtainable. It is therefore important to proceed the second ageing at low temperatures. Note, however, that too low second ageing temperature will inhibit newly precipitation of the second phase particles. Therefore the second ageing is preferably proceeded at 300° C. or above and 400° C. or below for 3 to 36 hours, and more preferably 300° C. or above and 350° C. or below for 9 to 30 hours.

In view of controlling the ratio of the number density of second phase particles having particle sizes of 5 nm or larger and smaller than 10 nm to 3 to 6, relative to the number density of second phase particles having particle sizes of 10 nm or larger and 50 nm or smaller, also relation between the second ageing time and the first ageing time holds the key. Specifically, by adjusting the second ageing time three times or more as long as the first ageing time, a relatively large population of the second phase particles having the particle sizes of 5 nm or larger and smaller than 10 nm will precipitate, and thereby the ratio of number density may be adjusted to 3 or larger. The second ageing time shorter than three times of the first ageing time will result in a relatively small population of the second phase particles having particle sizes of 5 nm or larger and smaller than 10 nm, and thereby the ratio of number density will tend to fall below 3.

On the other hand, if the second ageing time is very longer than the first ageing time (10 times or more, for example), the second phase particles having particle sizes of 5 nm or larger and smaller than 10 nm might increase, but also the second phase particles having particle sizes of 10 nm or larger and 50 nm or smaller will increase, due to growth of the precipitates having been produced in the first ageing, and growth of the precipitates having been produced in the second ageing, so that the ratio of number density will again tend to fall below 3.

Accordingly, the second ageing time is preferably adjusted to 3 to 10 times as long as the first ageing time, and more preferably 3 to 5 times.

The Cu—Ni—Si—Co-based alloy of the present invention may be processed into various types of wrought copper, such as sheet, strip, pipe, rod and wire. The Cu—Ni—Si—Co-based copper alloy of the present invention may further be applicable to electronic components such as lead frame, connector, pin, terminal, relay, switch, and foil for secondary battery, and particularly preferably adoptable to spring material.

EXAMPLES

Examples of the present invention will be shown together with Comparative Examples, merely for the purpose of better understanding of the present invention and advantages thereof, without limiting the invention.

1. Examples of the Present Invention (Ni not Added)

Each of copper alloys having compositions listed in Table 1 was melted at 1300° C. in a high-frequency melting furnace, and cast into an ingot of 30 mm thick. The ingot was then heated at 1000° C. for 3 hours, hot rolled down to 10 mm thick while setting the finish temperature (hot rolling termination temperature) to 900° C., and then quenched to room temperature quickly after the hot rolling by water cooling. Next, the surface was scalped so as to remove scales and thereby to reduce the thickness down to 9 mm, and then cold rolled into a sheet of 0.15 mm thick. The sheet was then subjected to solution treatment under the given temperature and time, and then quenched quickly after the solution treatment by water cooling. The sheet was then subjected to the first ageing in an inert atmosphere at the individual levels of temperature and time, cold rolled at each rolling reduction, and finally subjected to the second ageing in an inert atmosphere under the given temperature and time. Each specimen was manufactured in this way.

TABLE 1

| | Composition (mass %) | | | | Solution treatment | | 1st ageing | | Cold rolling | 2nd ageing | |
|---|---|---|---|---|---|---|---|---|---|---|---|
| | | | | | temp. | time | temp. | time | Rolling reduction | temp. | time |
| No | Co | Si | Cr | others | (° C.) | (s) | (° C.) | (hr) | (%) | (° C.) | (hr) |
| 1-1 | 1.9 | 0.4 | | | 950 | 60 | 520 | 3 | 15 | 350 | 9 |
| 1-2 | 1.9 | 0.4 | | | 950 | 60 | 520 | 3 | 15 | 325 | 15 |
| 1-3 | 1.9 | 0.4 | | | 950 | 60 | 520 | 3 | 15 | 300 | 30 |
| 1-4 | 1.9 | 0.4 | | | 950 | 60 | 520 | 3 | 10 | 325 | 15 |
| 1-5 | 1.9 | 0.4 | | | 950 | 60 | 520 | 3 | 25 | 300 | 30 |
| 1-6 | 1.9 | 0.4 | | | 950 | 60 | 490 | 9 | 15 | 300 | 30 |
| 1-7 | 1.9 | 0.4 | | | 950 | 60 | 490 | 9 | 10 | 300 | 30 |
| 1-8 | 1.9 | 0.4 | 0.2 | | 950 | 60 | 520 | 3 | 15 | 350 | 9 |
| 1-9 | 1.9 | 0.4 | 0.2 | | 950 | 60 | 520 | 3 | 15 | 325 | 15 |
| 1-10 | 1.9 | 0.4 | 0.2 | | 950 | 60 | 520 | 3 | 15 | 300 | 30 |
| 1-11 | 1.9 | 0.4 | 0.2 | | 950 | 60 | 520 | 3 | 10 | 325 | 15 |
| 1-12 | 1.9 | 0.4 | 0.2 | | 950 | 60 | 520 | 3 | 25 | 300 | 30 |
| 1-13 | 1.9 | 0.4 | 0.2 | | 950 | 60 | 490 | 9 | 15 | 300 | 30 |
| 1-14 | 1.9 | 0.4 | 0.2 | | 950 | 60 | 490 | 9 | 10 | 300 | 30 |
| 1-15 | 0.6 | 0.13 | | | 900 | 60 | 520 | 3 | 15 | 350 | 9 |
| 1-16 | 0.6 | 0.13 | | | 900 | 60 | 520 | 3 | 15 | 325 | 15 |
| 1-17 | 0.6 | 0.13 | | | 900 | 60 | 520 | 3 | 15 | 300 | 30 |
| 1-18 | 0.6 | 0.13 | | | 900 | 60 | 490 | 9 | 15 | 300 | 30 |
| 1-19 | 0.6 | 0.13 | | | 850 | 120 | 520 | 3 | 15 | 325 | 15 |
| 1-20 | 0.6 | 0.13 | 0.2 | | 900 | 60 | 520 | 3 | 15 | 350 | 9 |
| 1-21 | 0.6 | 0.13 | 0.2 | | 900 | 60 | 520 | 3 | 15 | 325 | 15 |
| 1-22 | 0.6 | 0.13 | 0.2 | | 900 | 60 | 520 | 3 | 15 | 300 | 30 |
| 1-23 | 0.6 | 0.13 | 0.2 | | 900 | 60 | 490 | 9 | 15 | 300 | 30 |
| 1-24 | 2.5 | 0.56 | | | 1020 | 60 | 520 | 3 | 15 | 350 | 9 |
| 1-25 | 2.5 | 0.56 | | | 1020 | 60 | 520 | 3 | 15 | 325 | 15 |
| 1-26 | 2.5 | 0.56 | | | 1020 | 60 | 520 | 3 | 15 | 300 | 30 |
| 1-27 | 2.5 | 0.56 | | | 1020 | 60 | 490 | 9 | 15 | 300 | 30 |
| 1-28 | 2.5 | 0.56 | 0.2 | | 1020 | 60 | 520 | 3 | 15 | 350 | 9 |
| 1-29 | 2.5 | 0.56 | 0.2 | | 1020 | 60 | 520 | 3 | 15 | 325 | 15 |
| 1-30 | 2.5 | 0.56 | 0.2 | | 1020 | 60 | 520 | 3 | 15 | 300 | 30 |
| 1-31 | 2.5 | 0.56 | 0.2 | | 1020 | 60 | 490 | 9 | 15 | 300 | 30 |
| 1-32 | 1.9 | 0.4 | | | 900 | 60 | 520 | 3 | 15 | 325 | 15 |
| 1-33 | 1.9 | 0.4 | 0.2 | | 900 | 60 | 520 | 3 | 15 | 325 | 15 |
| 1-34 | 1.9 | 0.4 | | | 1000 | 60 | 520 | 3 | 15 | 325 | 15 |
| 1-35 | 1.9 | 0.4 | 0.2 | | 1000 | 60 | 520 | 3 | 15 | 325 | 15 |
| 1-36 | 1.9 | 0.4 | | | 950 | 60 | 520 | 3 | 40 | 325 | 15 |
| 1-37 | 1.9 | 0.4 | | 0.1Mg | 950 | 60 | 520 | 3 | 15 | 325 | 15 |
| 1-38 | 1.9 | 0.4 | 0.2 | 0.1Mg | 950 | 60 | 520 | 3 | 15 | 325 | 15 |
| 1-39 | 1.9 | 0.4 | | 0.5Sn | 950 | 60 | 520 | 3 | 15 | 325 | 15 |
| 1-40 | 1.9 | 0.4 | | 0.5Zn | 950 | 60 | 520 | 3 | 15 | 325 | 15 |
| 1-41 | 1.9 | 0.4 | | 0.1Ag | 950 | 60 | 520 | 3 | 15 | 325 | 15 |
| 1-42 | 1.9 | 0.4 | 0.2 | 0.5Sn | 950 | 60 | 520 | 3 | 15 | 325 | 15 |
| 1-43 | 1.9 | 0.4 | 0.2 | 0.5Zn | 950 | 60 | 520 | 3 | 15 | 325 | 15 |
| 1-44 | 1.9 | 0.4 | 0.2 | 0.1Ag | 950 | 60 | 520 | 3 | 15 | 325 | 15 |
| 1-45 | 1.9 | 0.4 | 0.2 | 0.005B | 950 | 60 | 520 | 3 | 15 | 325 | 15 |
| 1-46 | 1.9 | 0.4 | 0.2 | 0.03Ti + 0.03Fe | 950 | 60 | 520 | 3 | 15 | 325 | 15 |
| 1-47 | 1.9 | 0.4 | | 0.05P + 0.05Mn + 0.05Zr | 950 | 60 | 520 | 3 | 15 | 325 | 15 |

Each of the thus-obtained specimens was measured with respect to the number density of second phase particles, and characteristics of alloy as explained below.

Each specimen was thinned by polishing down to 0.1 to 0.2 μm thick or around, observed randomly in five fields of view with a transmission microscope (HITACHI-H-9000) at a 100,000× magnification (with arbitrary incident azimuth), and the particle size of the second phase particles were measured on each of the five photographs. The particle size of the second phase particle was defined by (long diameter+short diameter)/2. The long diameter herein means length of the longest line segment, among the line segments which go through the center of gravity of a particle, and are limited at both ends by the intersections with the boundary of the particle. The short diameter herein means length of the shortest line segment, among the line segments which go through the center of gravity of a particle, and are limited at both ends by the intersections with the boundary of the particle. After the particle sizes were measured, numbers of particles which fall in the individual ranges of particle size were converted into the values per unit volume, and thereby values of the number density were determined for the individual ranges of particle size.

The strength was measured in terms of 0.2% yield strength (YS: MPa) by tensile test in the direction in parallel with the direction of rolling.

The electrical conductivity (EC: % IACS) was determined by measuring volume resistivity using a double-bridge circuit.

The anti-setting property was evaluated based on permanent deformation (setting) as listed in Table 2, which was determined by holding each specimen having a size of 1 mm (width)×100 mm (length)×0.08 mm (thickness) using a vise as illustrated in FIG. 1, and by applying bending stress to the specimen at a gage length of 5 mm and a stroke of 1 mm using a knife edge, at room temperature for 5 seconds. The initial anti-setting property was evaluated by applying the load once through the knife edge, and the repetitive anti-setting property was evaluated by applying the load ten times through the knife edge.

The bendability was evaluated by measuring MBR/t value, which was defined by a ratio of minimum bend radius (MBR) not causative of crack to thickness of specimen (t) when tested by W-bend test in the bad-way direction, in accordance with JIS H3130. MBR/t may be evaluated generally as follows:

MBR/t≤1.0 very good;

1.0<MBR/t≤2.0 good; and 2.0<MBR/t no good.

Results of measurement of the individual specimens are shown in Table 2.

TABLE 2

| | Number density of precipitates (a = particle size; nm) | | | | strength | electrical conductivity | initial | repetitive | |
|---|---|---|---|---|---|---|---|---|---|
| No | 5 ≤ a ≤ 50 | 5 ≤ a < 10 | 10 ≤ a ≤ 50 | Ratio of precipitates | YS (MPa) | EC (% IACS) | anti setting (mm) | anti setting (mm) | bendability |
| | Number of particles/mm$^3$ | | | | | | | | |
| 1-1 | 1.20E+13 | 9.00E+12 | 3.00E+12 | 3 | 703 | 59 | 0.03 | 0.10 | 0 |
| 1-2 | 1.00E+13 | 8.00E+12 | 2.00E+12 | 4 | 708 | 57 | 0.03 | 0.10 | 0 |
| 1-3 | 4.80E+12 | 4.00E+12 | 8.00E+11 | 5 | 695 | 55 | 0.03 | 0.13 | 0 |
| 1-4 | 4.80E+12 | 3.93E+12 | 8.73E+11 | 4.5 | 685 | 58 | 0.04 | 0.14 | 0 |
| 1-5 | 4.00E+12 | 3.33E+12 | 6.67E+11 | 5 | 705 | 54 | 0.03 | 0.12 | 0.5 |
| 1-6 | 1.32E+13 | 1.08E+13 | 2.40E+12 | 4.5 | 700 | 57 | 0.03 | 0.13 | 0.1 |
| 1-7 | 4.40E+12 | 3.52E+12 | 8.80E+11 | 4 | 685 | 58 | 0.04 | 0.14 | 0 |
| 1-8 | 1.68E+13 | 1.34E+13 | 3.36E+12 | 4 | 713 | 60 | 0.02 | 0.09 | 0 |
| 1-9 | 8.80E+12 | 7.33E+12 | 1.47E+12 | 5 | 718 | 58 | 0.02 | 0.09 | 0 |
| 1-10 | 4.80E+12 | 4.06E+12 | 7.38E+11 | 5.5 | 705 | 56 | 0.03 | 0.13 | 0 |
| 1-11 | 4.80E+12 | 3.93E+12 | 8.73E+11 | 4.5 | 695 | 59 | 0.03 | 0.12 | 0 |
| 1-12 | 4.80E+12 | 4.00E+12 | 8.00E+11 | 5 | 715 | 55 | 0.02 | 0.11 | 0.5 |
| 1-13 | 1.28E+13 | 1.05E+13 | 2.33E+12 | 4.5 | 710 | 58 | 0.03 | 0.11 | 0.1 |
| 1-14 | 4.40E+12 | 3.52E+12 | 8.80E+11 | 4 | 695 | 59 | 0.03 | 0.12 | 0 |
| 1-15 | 4.80E+12 | 3.73E+12 | 1.07E+12 | 3.5 | 560 | 74 | 0.09 | 0.19 | 0 |
| 1-16 | 3.60E+12 | 3.00E+12 | 6.00E+11 | 5 | 565 | 72 | 0.08 | 0.20 | 0 |
| 1-17 | 2.80E+12 | 2.37E+12 | 4.31E+11 | 5.5 | 555 | 71 | 0.09 | 0.22 | 0 |
| 1-18 | 4.00E+12 | 3.27E+12 | 7.27E+11 | 4.5 | 558 | 72 | 0.09 | 0.19 | 0 |
| 1-19 | 3.60E+12 | 2.70E+12 | 9.00E+11 | 3 | 545 | 74 | 0.10 | 0.20 | 0 |
| 1-20 | 4.80E+12 | 3.84E+12 | 9.60E+11 | 4 | 570 | 75 | 0.08 | 0.18 | 0 |
| 1-21 | 3.60E+12 | 2.95E+12 | 6.55E+11 | 4.5 | 575 | 73 | 0.08 | 0.21 | 0 |
| 1-22 | 2.80E+12 | 2.37E+12 | 4.31E+11 | 5.5 | 565 | 72 | 0.08 | 0.22 | 0 |
| 1-23 | 3.60E+12 | 2.95E+12 | 6.55E+11 | 4.5 | 568 | 73 | 0.08 | 0.18 | 0 |
| 1-24 | 8.80E+13 | 6.84E+13 | 1.96E+13 | 3.5 | 707 | 58 | 0.03 | 0.10 | 0.8 |
| 1-25 | 5.20E+13 | 4.33E+13 | 8.67E+12 | 5 | 715 | 57 | 0.02 | 0.09 | 1 |
| 1-26 | 3.60E+13 | 3.05E+13 | 5.54E+12 | 5.5 | 700 | 56 | 0.03 | 0.14 | 0.9 |
| 1-27 | 4.40E+13 | 3.52E+13 | 8.80E+12 | 4 | 704 | 56 | 0.03 | 0.11 | 0.8 |
| 1-28 | 8.00E+13 | 6.22E+13 | 1.78E+13 | 3.5 | 717 | 59 | 0.02 | 0.09 | 1 |
| 1-29 | 4.00E+13 | 3.27E+13 | 7.27E+12 | 4.5 | 725 | 58 | 0.02 | 0.08 | 1.2 |
| 1-30 | 3.60E+13 | 3.05E+13 | 5.54E+12 | 5.5 | 710 | 57 | 0.03 | 0.12 | 1 |
| 1-31 | 4.80E+13 | 3.84E+13 | 9.60E+12 | 4 | 714 | 57 | 0.02 | 0.09 | 1 |
| 1-32 | 8.80E+12 | 7.33E+12 | 1.47E+12 | 5 | 680 | 59 | 0.04 | 0.15 | 0 |
| 1-33 | 8.80E+12 | 7.20E+12 | 1.60E+12 | 4.5 | 690 | 60 | 0.03 | 0.13 | 0 |
| 1-34 | 1.40E+13 | 1.12E+13 | 2.80E+12 | 4 | 720 | 56 | 0.02 | 0.08 | 0.2 |
| 1-35 | 1.20E+13 | 9.82E+12 | 2.18E+12 | 4.5 | 730 | 57 | 0.02 | 0.07 | 0.3 |
| 1-36 | 1.00E+13 | 8.00E+12 | 2.00E+12 | 4 | 728 | 56 | 0.02 | 0.06 | 1 |
| 1-37 | 1.68E+13 | 1.31E+13 | 3.73E+12 | 3.5 | 738 | 54 | 0.01 | 0.06 | 0.5 |
| 1-38 | 1.60E+13 | 1.28E+13 | 3.20E+12 | 4 | 748 | 55 | 0.01 | 0.04 | 0.5 |
| 1-39 | 9.60E+12 | 7.68E+12 | 1.92E+12 | 4 | 718 | 53 | 0.02 | 0.09 | 0.2 |
| 1-40 | 8.80E+12 | 7.20E+12 | 1.60E+12 | 4.5 | 715 | 52 | 0.02 | 0.09 | 0.2 |
| 1-41 | 1.20E+13 | 9.82E+12 | 2.18E+12 | 4.5 | 705 | 56 | 0.03 | 0.11 | 0.1 |

TABLE 2-continued

| No | Number density of precipitates (a = particle size; nm) 5 ≤ a ≤ 50 Number of particles/mm³ | 5 ≤ a < 10 | 10 ≤ a ≤ 50 | Ratio of precipitates | strength YS (MPa) | electrical conductivity EC (% IACS) | initial anti setting (mm) | repetitive anti setting (mm) | bendability |
|---|---|---|---|---|---|---|---|---|---|
| 1-42 | 1.00E+13 | 8.00E+12 | 2.00E+12 | 4 | 728 | 54 | 0.02 | 0.07 | 0.3 |
| 1-43 | 8.00E+12 | 6.67E+12 | 1.33E+12 | 5 | 725 | 53 | 0.02 | 0.08 | 0.2 |
| 1-44 | 1.28E+13 | 1.02E+13 | 2.56E+12 | 4 | 715 | 57 | 0.02 | 0.09 | 0.1 |
| 1-45 | 9.60E+12 | 7.85E+12 | 1.75E+12 | 4.5 | 708 | 54 | 0.03 | 0.10 | 0.1 |
| 1-46 | 8.80E+12 | 7.20E+12 | 1.60E+12 | 4.5 | 718 | 55 | 0.02 | 0.09 | 0.2 |
| 1-47 | 1.00E+13 | 8.00E+12 | 2.00E+12 | 4 | 718 | 57 | 0.02 | 0.09 | 0 |

2. Comparative Examples (Ni not Added)

Each of copper alloys having compositions listed in Table 3 was melted at 1300° C. in a high-frequency melting furnace, and cast into an ingot of 30 mm thick. The ingot was then heated at 1000° C. for 3 hours, hot rolled down to 10 mm thick while setting the finish temperature (hot rolling termination temperature) to 900° C., and then quenched to room temperature quickly after the hot rolling by water cooling. Next, the surface was scalped so as to remove scales and thereby to reduce the thickness down to 9 mm, and then cold rolled into a sheet of 0.15 mm thick. The sheet was then subjected to solution treatment under the given temperature and time, and then quenched quickly after the solution treatment by water cooling. The sheet was then subjected to the first ageing in an inert atmosphere under the given temperature and time, cold rolled at each rolling reduction, and finally subjected to the second ageing in an inert atmosphere under the given temperature and time. Each specimen was manufactured in this way.

TABLE 3

| No | Composition (mass %) Co | Si | Cr | others | Solution treatment temp. (° C.) | time (s) | 1st ageing temp. (° C.) | time (hr) | Cold rolling Rolling reduction (%) | 2nd ageing temp. (° C.) | time (hr) |
|---|---|---|---|---|---|---|---|---|---|---|---|
| 1-48 | 1.9 | 0.4 | | | 1000 | 60 | 375 | 24 | 15 | 275 | 48 |
| 1-49 | 1.9 | 0.4 | | | 1000 | 60 | 490 | 9 | 15 | 275 | 48 |
| 1-50 | 1.9 | 0.4 | | | 1000 | 60 | 625 | 3 | 15 | 275 | 48 |
| 1-51 | 1.9 | 0.4 | | | 1000 | 60 | 375 | 24 | 15 | 350 | 12 |
| 1-52 | 1.9 | 0.4 | | | 1000 | 60 | 625 | 3 | 15 | 350 | 12 |
| 1-53 | 1.9 | 0.4 | | | 1000 | 60 | 375 | 24 | 15 | 450 | 3 |
| 1-54 | 1.9 | 0.4 | | | 1000 | 60 | 490 | 9 | 15 | 450 | 3 |
| 1-55 | 1.9 | 0.4 | | | 1000 | 60 | 625 | 3 | 15 | 450 | 3 |
| 1-56 | 1.9 | 0.4 | | | 1000 | 60 | 650 | 3 | 15 | 350 | 12 |
| 1-57 | 1.9 | 0.4 | | | 1000 | 60 | 520 | 48 | 15 | 350 | 48 |
| 1-58 | 1.9 | 0.4 | 0.2 | | 1000 | 60 | 375 | 24 | 15 | 275 | 48 |
| 1-59 | 1.9 | 0.4 | 0.2 | | 1000 | 60 | 490 | 9 | 15 | 275 | 48 |
| 1-60 | 1.9 | 0.4 | 0.2 | | 1000 | 60 | 625 | 3 | 15 | 275 | 48 |
| 1-61 | 1.9 | 0.4 | 0.2 | | 1000 | 60 | 375 | 24 | 15 | 350 | 12 |
| 1-62 | 1.9 | 0.4 | 0.2 | | 1000 | 60 | 625 | 3 | 15 | 350 | 12 |
| 1-63 | 1.9 | 0.4 | 0.2 | | 1000 | 60 | 375 | 24 | 15 | 450 | 3 |
| 1-64 | 1.9 | 0.4 | 0.2 | | 1000 | 60 | 490 | 9 | 15 | 450 | 3 |
| 1-65 | 1.9 | 0.4 | 0.2 | | 1000 | 60 | 625 | 3 | 15 | 450 | 3 |
| 1-66 | 1.9 | 0.4 | 0.2 | | 1000 | 60 | 650 | 3 | 15 | 350 | 12 |
| 1-67 | 1.9 | 0.4 | 0.2 | | 1000 | 60 | 520 | 48 | 15 | 350 | 48 |
| 1-68 | 1.9 | 0.4 | | 0.1Mg | 1000 | 60 | 375 | 24 | 15 | 275 | 48 |
| 1-69 | 1.9 | 0.4 | | 0.1Mg | 1000 | 60 | 625 | 3 | 15 | 275 | 48 |
| 1-70 | 1.9 | 0.4 | | 0.1Mg | 1000 | 60 | 375 | 24 | 15 | 450 | 3 |
| 1-71 | 1.9 | 0.4 | | 0.1Mg | 1000 | 60 | 625 | 3 | 15 | 450 | 3 |
| 1-72 | 1.9 | 0.4 | 0.2 | 0.1Mg | 1000 | 60 | 375 | 24 | 15 | 275 | 48 |
| 1-73 | 1.9 | 0.4 | 0.2 | 0.1Mg | 1000 | 60 | 625 | 3 | 15 | 275 | 48 |
| 1-74 | 1.9 | 0.4 | 0.2 | 0.1Mg | 1000 | 60 | 375 | 24 | 15 | 450 | 3 |
| 1-75 | 1.9 | 0.4 | 0.2 | 0.1Mg | 1000 | 60 | 625 | 3 | 15 | 450 | 3 |
| 1-76 | 1.9 | 0.4 | | | 1000 | 60 | 520 | 3 | 5 | 350 | 12 |
| 1-77 | 1.9 | 0.4 | 0.2 | | 1000 | 60 | 520 | 3 | 5 | 350 | 12 |
| 1-78 | 1.9 | 0.4 | | | 1000 | 60 | 520 | 3 | 60 | 350 | 12 |
| 1-79 | 1.9 | 0.4 | 0.2 | | 1000 | 60 | 520 | 3 | 60 | 350 | 12 |
| 1-80 | 1.9 | 0.4 | 0.2 | | 1000 | 60 | 520 | 3 | 15 | — | — |

TABLE 3-continued

| | Composition (mass %) | | | | Solution treatment | | 1st ageing | | Cold rolling | 2nd ageing | |
|---|---|---|---|---|---|---|---|---|---|---|---|
| | | | | | temp. | time | temp. | time | Rolling reduction | temp. | time |
| No | Co | Si | Cr | others | (° C.) | (s) | (° C.) | (hr) | (%) | (° C.) | (hr) |
| 1-81 | 1.9 | 0.4 | 0.2 | | 1000 | 60 | 520 | 3 | — | — | — |
| 1-82 | 1.9 | 0.4 | | | 1000 | 60 | 520 | 3 | 15 | 325 | 1 |
| 1-83 | 1.9 | 0.4 | | | 1000 | 60 | 520 | 3 | 15 | 325 | 48 |

The thus obtained specimens were measured with respect to the number density of second phase particles, and alloy characteristics similarly to Examples of the present invention. Results of measurement were shown in Table 4.

TABLE 4

| | Number density of precipitates (a = particle size; nm) | | | | strength | electrical conductivity | initial | repetitive | |
|---|---|---|---|---|---|---|---|---|---|
| No | $5 \leq a \leq 50$ | $5 \leq a < 10$ | $10 \leq a \leq 50$ | Ratio of precipitate | YS (MPa) | EC (% IACS) | anti setting (mm) | anti setting (mm) | bendability |
| | Number of particles/mm$^3$ | | | | | | | | |
| 1-48 | 3.28E+11 | 2.95E+11 | 3.28E+10 | 9 | 490 | 45 | 0.29 | 0.40 | 0 |
| 1-49 | 3.32E+12 | 2.37E+12 | 9.49E+11 | 2.5 | 580 | 52 | 0.20 | 0.35 | 0 |
| 1-50 | 3.00E+12 | 2.00E+12 | 1.00E+12 | 2 | 530 | 59 | 0.24 | 0.39 | 0 |
| 1-51 | 3.60E+11 | 3.18E+11 | 4.24E+10 | 7.5 | 510 | 47 | 0.25 | 0.48 | 0 |
| 1-52 | 3.40E+12 | 2.98E+12 | 4.25E+11 | 7 | 510 | 61 | 0.25 | 0.47 | 0 |
| 1-53 | 4.80E+12 | 2.88E+12 | 1.92E+12 | 1.5 | 560 | 52 | 0.21 | 0.35 | 0 |
| 1-54 | 1.28E+13 | 4.27E+12 | 8.53E+12 | 0.5 | 550 | 56 | 0.22 | 0.37 | 0 |
| 1-55 | 2.80E+11 | 2.55E+10 | 2.55E+11 | 0.1 | 450 | 65 | 0.32 | 0.48 | 0 |
| 1-56 | 2.00E+11 | 1.67E+11 | 3.33E+10 | 5 | 450 | 64 | 0.32 | 0.58 | 0 |
| 1-57 | 9.00E+11 | 6.00E+11 | 3.00E+11 | 2.5 | 530 | 60 | 0.24 | 0.41 | 0 |
| 1-58 | 3.60E+11 | 3.26E+11 | 3.43E+10 | 9.5 | 500 | 46 | 0.26 | 0.50 | 0 |
| 1-59 | 3.28E+12 | 2.37E+12 | 9.11E+11 | 2.6 | 590 | 53 | 0.18 | 0.33 | 0 |
| 1-60 | 2.88E+12 | 2.06E+12 | 8.23E+11 | 2.5 | 540 | 60 | 0.22 | 0.40 | 0 |
| 1-61 | 3.60E+11 | 3.20E+11 | 4.00E+10 | 8 | 520 | 48 | 0.25 | 0.46 | 0 |
| 1-62 | 3.40E+12 | 3.00E+12 | 4.00E+11 | 7.5 | 520 | 62 | 0.25 | 0.46 | 0 |
| 1-63 | 4.40E+12 | 2.64E+12 | 1.76E+12 | 1.5 | 570 | 53 | 0.19 | 0.35 | 0 |
| 1-64 | 1.32E+13 | 4.40E+12 | 8.80E+12 | 0.5 | 560 | 51 | 0.20 | 0.36 | 0 |
| 1-65 | 2.80E+11 | 2.55E+10 | 2.55E+11 | 0.1 | 460 | 66 | 0.32 | 0.49 | 0 |
| 1-66 | 1.00E+11 | 8.57E+10 | 1.43E+10 | 6 | 465 | 66 | 0.31 | 0.57 | 0 |
| 1-67 | 9.90E+11 | 6.60E+11 | 3.30E+11 | 2.5 | 540 | 61 | 0.23 | 0.40 | 0 |
| 1-68 | 3.40E+11 | 3.08E+11 | 3.24E+10 | 9.5 | 510 | 43 | 0.25 | 0.48 | 0 |
| 1-69 | 3.40E+12 | 2.27E+12 | 1.13E+12 | 2 | 550 | 57 | 0.22 | 0.39 | 0 |
| 1-70 | 4.80E+12 | 2.88E+12 | 1.92E+12 | 1.5 | 580 | 50 | 0.19 | 0.36 | 0 |
| 1-71 | 2.80E+11 | 2.55E+10 | 2.55E+11 | 0.1 | 470 | 63 | 0.30 | 0.49 | 0 |
| 1-72 | 3.20E+11 | 2.92E+11 | 2.78E+10 | 10.5 | 520 | 44 | 0.25 | 0.48 | 0 |
| 1-73 | 3.40E+12 | 2.43E+12 | 9.71E+11 | 2.5 | 560 | 58 | 0.21 | 0.37 | 0 |
| 1-74 | 4.00E+12 | 2.40E+12 | 1.60E+12 | 1.5 | 590 | 64 | 0.18 | 0.34 | 0 |
| 1-75 | 2.80E+11 | 2.55E+10 | 2.55E+11 | 0.1 | 480 | 45 | 0.29 | 0.46 | 0 |
| 1-76 | 4.40E+12 | 2.93E+12 | 1.47E+12 | 2 | 600 | 56 | 0.17 | 0.32 | 0 |
| 1-77 | 4.80E+12 | 3.43E+12 | 1.37E+12 | 2.5 | 610 | 57 | 0.16 | 0.31 | 0 |
| 1-78 | 8.80E+12 | 7.33E+12 | 1.47E+12 | 5 | 650 | 58 | 0.14 | 0.26 | 2 |
| 1-79 | 8.00E+12 | 6.77E+12 | 1.23E+12 | 5.5 | 660 | 58 | 0.13 | 0.24 | 2 |
| 1-80 | 3.97E+10 | 2.55E+10 | 1.43E+10 | 1.7 | 610 | 55 | 0.16 | 0.31 | 0 |
| 1-81 | 1.61E+13 | 7.33E+12 | 8.80E+12 | 0.7 | 430 | 56 | 0.34 | 0.54 | 0 |
| 1-82 | 3.60E+12 | 2.57E+12 | 1.03E+12 | 2.5 | 600 | 56 | 0.17 | 0.31 | 0 |
| 1-83 | 5.20E+12 | 3.67E+12 | 1.53E+12 | 2.4 | 590 | 53 | 0.19 | 0.34 | 0 |

3. Discussion

<No. 1-1 to 1-47>

All of the strength, electrical conductivity, anti-setting property and bendability were found to be excellent, by virtue of appropriate values of number density of second phase particles.

<No. 1-48, 1-58, 1-68, 1-72>

The second phase particles having particles sizes of 5 nm or larger and 50 nm or smaller were generally found to be insufficient, due to low temperature settings in the first ageing and the second ageing.

<No. 1-49, 1-59>

Ratios of the second phase particles having particle sizes of 5 nm or larger and smaller than 10 nm were found to be small, due to low temperature settings in the second ageing.

<No. 1-50, 1-60, 1-69, 1-73>

Ratios of the second phase particles having particle sizes of 5 nm or larger and smaller than 10 nm were found to be small, due to high temperature settings in the first ageing and low temperature settings in the second ageing.

<No. 1-51, 1-61>

The second phase particles having particle sizes of 5 nm or larger and 50 nm or smaller were generally found to be insufficient, due to low temperature settings in the first ageing.

<No. 1-52, 1-56, 1-62, 1-66>

The second phase particles having particle sizes of 5 nm or larger and 50 nm or smaller were generally found to be insufficient, or, the second phase particles having particle sizes of 10 nm or larger and 50 nm or smaller, and the second phase particles having particle sizes of 5 nm or larger and smaller than 10 nm were found to be unbalanced, due to high temperature settings in the first ageing.

<No. 1-53, 1-63, 1-70, 1-74>

The second phase particles having particle sizes of 10 nm or larger and 50 nm or smaller, and the second phase particles having particle sizes of 5 nm or larger and smaller than 10 nm were found to be unbalanced, due to low temperature settings in the first ageing, and high temperature settings in the second ageing.

<No. 1-54, 1-64>

Ratios of the second phase particles having particle sizes of 5 nm or larger and smaller than 10 nm were found to be small, due to high temperature settings in the second ageing.

<No. 1-55, 1-65, 1-71, 1-75>

The second phase particles having particle sizes of 5 nm or larger and 50 nm or smaller specified by the present invention were generally found to be insufficient, due to high temperature settings in the first ageing and in the second ageing, and generally excessive growth of the second phase particles as a consequence.

<No. 1-57, 1-67>

The second phase particles having particle sizes of 5 nm or larger and smaller than 10 nm were found to be insufficient, due to long time settings in the first ageing and in the second ageing.

<No. 1-76, 1-77>

Ratios of the second phase particles having particle sizes of 5 nm or larger and smaller than 10 nm were found to be small, due to small values of rolling reduction of cold rolling between the first ageing and in the second ageing, and due to weakened effects of the second ageing as a consequence.

<No. 1-78, 1-79>

Although Nos. 1-78 and 1-79 were inventive examples, the bendability values were found to be lowered, due to large values of rolling reduction of cold rolling between the first ageing and the second ageing, and due to increased effects of the second ageing as a consequence.

<No. 1-80, 1-81>

Ratios of the second phase particles having particle sizes of 5 nm or larger and smaller than 10 nm were found to be small, due to omission of the second ageing.

<No. 1-82>

Ratio of the second phase particles having particle sizes of 5 nm or larger and smaller than 10 nm was found to be small, due to shorter ageing time in the second ageing as compared with the first ageing.

<No. 1-83>

Ratio of the second phase particles having particle sizes of 5 nm or larger and smaller than 10 nm was found to be small, due to too long ageing time in the second ageing as compared with the first ageing. 4. Examples of the Present Invention (Ni Added)

Each of copper alloys having compositions listed in Table 5 was melted at 1300° C. in a high-frequency melting furnace, and cast into an ingot of 30 mm thick. The ingot was then heated at 1000° C. for 3 hours, hot rolled down to 10 mm thick while setting the finish temperature (hot rolling termination temperature) to 900° C., and then quenched to room temperature quickly after the hot rolling by water cooling. Next, the surface was scalped so as to remove scales and thereby to reduce the thickness down to 9 mm, and then cold rolled into a sheet of 0.15 mm thick. The sheet was then subjected to solution treatment under the given temperature and time, and then quenched quickly after the solution treatment by water cooling. The sheet was then subjected to the first ageing in an inert atmosphere under the given temperature and time, cold rolled at each rolling reduction, and finally subjected to the second ageing in an inert atmosphere under the given temperature and time. Each specimen was manufactured in this way.

TABLE 5

| | Composition (mass %) | | | | | Solution treatment | | 1st ageing | | Cold rolling | 2nd ageing | |
|---|---|---|---|---|---|---|---|---|---|---|---|---|
| | | | | | | temp. | time | temp. | time | Rolling reduction | temp. | time |
| No | Ni | Co | Si | Cr | others | (° C.) | (s) | (° C.) | (hr) | (%) | (° C.) | (hr) |
| 2-1 | 1.8 | 1.0 | 0.65 | | | 1000 | 60 | 480 | 3 | 40 | 350 | 9 |
| 2-2 | 1.8 | 1.0 | 0.65 | | | 1000 | 60 | 480 | 3 | 40 | 325 | 15 |
| 2-3 | 1.8 | 1.0 | 0.65 | | | 1000 | 60 | 480 | 3 | 40 | 300 | 30 |
| 2-4 | 1.8 | 1.0 | 0.65 | | | 1000 | 60 | 480 | 3 | 30 | 325 | 15 |
| 2-5 | 1.8 | 1.0 | 0.65 | | | 1000 | 60 | 480 | 3 | 50 | 300 | 30 |
| 2-6 | 1.8 | 1.0 | 0.65 | | | 1000 | 60 | 450 | 9 | 40 | 300 | 30 |
| 2-7 | 1.8 | 1.0 | 0.65 | | | 1000 | 60 | 450 | 9 | 40 | 300 | 30 |
| 2-8 | 1.8 | 1.0 | 0.65 | | | 1000 | 60 | 450 | 9 | 30 | 300 | 30 |
| 2-9 | 1.8 | 1.0 | 0.65 | 0.2 | | 1000 | 60 | 480 | 3 | 40 | 350 | 9 |
| 2-10 | 1.8 | 1.0 | 0.65 | 0.2 | | 1000 | 60 | 480 | 3 | 40 | 325 | 15 |
| 2-11 | 1.8 | 1.0 | 0.65 | 0.2 | | 1000 | 60 | 480 | 3 | 40 | 300 | 30 |
| 2-12 | 1.8 | 1.0 | 0.65 | 0.2 | | 1000 | 60 | 480 | 3 | 30 | 325 | 15 |
| 2-13 | 1.8 | 1.0 | 0.65 | 0.2 | | 1000 | 60 | 480 | 3 | 50 | 300 | 30 |
| 2-14 | 1.8 | 1.0 | 0.65 | 0.2 | | 1000 | 60 | 450 | 9 | 40 | 300 | 30 |
| 2-15 | 1.8 | 1.0 | 0.65 | 0.2 | | 1000 | 60 | 450 | 9 | 40 | 300 | 30 |
| 2-16 | 1.8 | 1.0 | 0.65 | 0.2 | | 1000 | 60 | 450 | 9 | 30 | 300 | 30 |
| 2-17 | 1.8 | 0.6 | 0.54 | | | 950 | 60 | 480 | 3 | 40 | 350 | 9 |
| 2-18 | 1.8 | 0.6 | 0.54 | | | 950 | 60 | 480 | 3 | 40 | 325 | 15 |
| 2-19 | 1.8 | 0.6 | 0.54 | | | 950 | 60 | 480 | 3 | 40 | 300 | 30 |
| 2-20 | 1.8 | 0.6 | 0.54 | | | 950 | 60 | 450 | 9 | 40 | 300 | 30 |
| 2-21 | 1.8 | 0.6 | 0.54 | | | 950 | 60 | 450 | 9 | 40 | 300 | 30 |
| 2-22 | 1.8 | 0.6 | 0.54 | 0.2 | | 950 | 60 | 480 | 3 | 40 | 350 | 9 |
| 2-23 | 1.8 | 0.6 | 0.54 | 0.2 | | 950 | 60 | 480 | 3 | 40 | 325 | 15 |
| 2-24 | 1.8 | 0.6 | 0.54 | 0.2 | | 950 | 60 | 480 | 3 | 40 | 300 | 30 |
| 2-25 | 1.8 | 0.6 | 0.54 | 0.2 | | 950 | 60 | 450 | 9 | 40 | 300 | 30 |
| 2-26 | 1.8 | 0.6 | 0.54 | 0.2 | | 950 | 60 | 450 | 9 | 40 | 300 | 30 |
| 2-27 | 1.8 | 1.5 | 0.81 | | | 1020 | 60 | 480 | 3 | 40 | 350 | 9 |

TABLE 5-continued

| | Composition (mass %) | | | | | Solution treatment | | 1st ageing | | Cold rolling | 2nd ageing | |
|---|---|---|---|---|---|---|---|---|---|---|---|---|
| | | | | | | temp. | time | temp. | time | Rolling reduction | temp. | time |
| No | Ni | Co | Si | Cr | others | (° C.) | (s) | (° C.) | (hr) | (%) | (° C.) | (hr) |
| 2-28 | 1.8 | 1.5 | 0.81 | | | 1020 | 60 | 480 | 3 | 40 | 325 | 15 |
| 2-29 | 1.8 | 1.5 | 0.81 | | | 1020 | 60 | 480 | 3 | 40 | 300 | 30 |
| 2-30 | 1.8 | 1.5 | 0.81 | | | 1020 | 60 | 450 | 9 | 40 | 300 | 30 |
| 2-31 | 1.8 | 1.5 | 0.81 | | | 1020 | 60 | 450 | 9 | 40 | 300 | 30 |
| 2-32 | 1.8 | 1.5 | 0.81 | 0.2 | | 1020 | 60 | 480 | 3 | 40 | 350 | 9 |
| 2-33 | 1.8 | 1.5 | 0.81 | 0.2 | | 1020 | 60 | 480 | 3 | 40 | 325 | 15 |
| 2-34 | 1.8 | 1.5 | 0.81 | 0.2 | | 1020 | 60 | 480 | 3 | 40 | 300 | 30 |
| 2-35 | 1.8 | 1.5 | 0.81 | 0.2 | | 1020 | 60 | 450 | 9 | 40 | 300 | 30 |
| 2-36 | 1.8 | 1.5 | 0.81 | 0.2 | | 1020 | 60 | 450 | 9 | 40 | 300 | 30 |
| 2-37 | 1.5 | 1.0 | 0.6 | | | 970 | 60 | 480 | 3 | 40 | 325 | 15 |
| 2-38 | 1.5 | 1.0 | 0.6 | 0.2 | | 970 | 60 | 480 | 3 | 40 | 325 | 15 |
| 2-39 | 2.0 | 1.0 | 0.75 | | | 1020 | 60 | 480 | 3 | 40 | 325 | 15 |
| 2-40 | 2.0 | 1.0 | 0.75 | 0.2 | | 1020 | 60 | 480 | 3 | 40 | 325 | 15 |
| 2-41 | 1.8 | 1.0 | 0.65 | | | 1000 | 60 | 480 | 3 | 15 | 325 | 15 |
| 2-42 | 1.8 | 1.0 | 0.65 | | 0.1Mg | 1000 | 60 | 480 | 3 | 40 | 325 | 15 |
| 2-43 | 1.8 | 1.0 | 0.65 | 0.2 | 0.1Mg | 1000 | 60 | 480 | 3 | 40 | 325 | 15 |
| 2-44 | 1.8 | 1.0 | 0.65 | | 0.5Sn | 1000 | 60 | 480 | 3 | 40 | 325 | 15 |
| 2-45 | 1.8 | 1.0 | 0.65 | | 0.5Zn | 1000 | 60 | 480 | 3 | 40 | 325 | 15 |
| 2-46 | 1.8 | 1.0 | 0.65 | | 0.1Ag | 1000 | 60 | 480 | 3 | 40 | 325 | 15 |
| 2-47 | 1.8 | 1.0 | 0.65 | 0.2 | 0.5Sn | 1000 | 60 | 480 | 3 | 40 | 325 | 15 |
| 2-48 | 1.8 | 1.0 | 0.65 | 0.2 | 0.5Zn | 1000 | 60 | 480 | 3 | 40 | 325 | 15 |
| 2-49 | 1.8 | 1.0 | 0.65 | 0.2 | 0.1Ag | 1000 | 60 | 480 | 3 | 40 | 325 | 15 |
| 2-50 | 1.8 | 1.0 | 0.65 | 0.2 | 0.005B | 1000 | 60 | 480 | 3 | 40 | 325 | 15 |
| 2-51 | 1.8 | 1.0 | 0.65 | 0.2 | 0.03Ti + 0.03Fe | 1000 | 60 | 480 | 3 | 40 | 325 | 15 |
| 2-52 | 2.5 | 1.0 | 0.83 | | | 1020 | 60 | 480 | 3 | 40 | 325 | 15 |
| 2-53 | 2.5 | 1.0 | 0.83 | 0.2 | | 1020 | 60 | 480 | 3 | 40 | 325 | 15 |
| 2-54 | 1.8 | 1.0 | 0.65 | | 0.05P + 0.05Mn + 0.0.5Zr | 1000 | 60 | 480 | 3 | 40 | 325 | 15 |

The thus obtained specimens were measured with respect to the number density of second phase particles, and alloy characteristics similarly as described in the above. Results of measurement were shown in Table 6.

TABLE 6

| | Number density of precipitates (a = particle size; nm) | | | | strength | electrical conductivity | initial | repetitive | |
|---|---|---|---|---|---|---|---|---|---|
| No | $5 \leq a \leq 50$ Number of particles/mm$^3$ | $5 \leq a < 10$ | $10 \leq a \leq 50$ | Ratio of precipitate | YS (MPa) | EC (% IACS) | anti setting (mm) | anti setting (mm) | bendability |
| 2-1 | 1.60E+13 | 1.24E+13 | 3.56E+12 | 3.5 | 850 | 48 | 0 | 0.02 | 1.5 |
| 2-2 | 8.00E+12 | 6.55E+12 | 1.45E+12 | 4.5 | 860 | 45 | 0.01 | 0.05 | 1.5 |
| 2-3 | 4.00E+12 | 3.38E+12 | 6.15E+11 | 5.5 | 855 | 43 | 0.04 | 0.09 | 1.5 |
| 2-4 | 4.00E+12 | 3.20E+12 | 8.00E+11 | 4 | 850 | 44 | 0.03 | 0.07 | 1 |
| 2-5 | 4.00E+12 | 3.33E+12 | 6.67E+11 | 5 | 865 | 44 | 0.03 | 0.08 | 2 |
| 2-6 | 1.20E+13 | 9.60E+12 | 2.40E+12 | 4 | 860 | 46 | 0.01 | 0.04 | 1.5 |
| 2-7 | 4.00E+12 | 3.33E+12 | 6.67E+11 | 5 | 850 | 43 | 0.03 | 0.08 | 1.5 |
| 2-8 | 4.00E+12 | 3.20E+12 | 8.00E+11 | 4 | 845 | 43 | 0.03 | 0.07 | 1 |
| 2-9 | 1.60E+13 | 1.24E+13 | 3.56E+12 | 3.5 | 860 | 48 | 0 | 0.02 | 1.5 |
| 2-10 | 8.00E+12 | 6.55E+12 | 1.45E+12 | 4.5 | 870 | 46 | 0.01 | 0.05 | 1.5 |
| 2-11 | 4.00E+12 | 3.38E+12 | 6.15E+11 | 5.5 | 865 | 44 | 0.04 | 0.09 | 1.5 |
| 2-12 | 4.00E+12 | 3.20E+12 | 8.00E+11 | 4 | 860 | 45 | 0.04 | 0.08 | 1 |
| 2-13 | 4.00E+12 | 3.33E+12 | 6.67E+11 | 5 | 875 | 45 | 0.03 | 0.08 | 2 |
| 2-14 | 1.20E+13 | 9.60E+12 | 2.40E+12 | 4 | 870 | 47 | 0 | 0.04 | 1.5 |
| 2-15 | 4.00E+12 | 3.33E+12 | 6.67E+11 | 5 | 860 | 44 | 0.03 | 0.08 | 1.5 |
| 2-16 | 4.00E+12 | 3.20E+12 | 8.00E+11 | 4 | 855 | 44 | 0.03 | 0.07 | 1 |
| 2-17 | 4.00E+12 | 3.11E+12 | 8.89E+11 | 3.5 | 835 | 49 | 0 | 0.02 | 1.2 |
| 2-18 | 3.20E+12 | 2.62E+12 | 5.82E+11 | 4.5 | 845 | 46 | 0.02 | 0.06 | 1.5 |
| 2-19 | 2.40E+12 | 2.03E+12 | 3.69E+11 | 5.5 | 840 | 44 | 0.04 | 0.09 | 1.5 |
| 2-20 | 3.60E+12 | 2.88E+12 | 7.20E+11 | 4 | 835 | 46 | 0 | 0.04 | 1.2 |
| 2-21 | 3.20E+12 | 2.67E+12 | 5.33E+11 | 5 | 850 | 44 | 0.02 | 0.07 | 1.5 |
| 2-22 | 4.00E+12 | 3.11E+12 | 8.89E+11 | 3.5 | 845 | 48 | 0 | 0.02 | 1.5 |
| 2-23 | 3.20E+12 | 2.62E+12 | 5.82E+11 | 4.5 | 835 | 47 | 0.02 | 0.06 | 1.2 |
| 2-24 | 2.40E+12 | 2.03E+12 | 3.69E+11 | 5.5 | 840 | 45 | 0.03 | 0.08 | 1.5 |
| 2-25 | 3.60E+12 | 2.88E+12 | 7.20E+11 | 4 | 865 | 46 | 0.01 | 0.04 | 1.5 |
| 2-26 | 3.20E+12 | 2.67E+12 | 5.33E+11 | 5 | 865 | 45 | 0.02 | 0.07 | 1.5 |
| 2-27 | 8.00E+13 | 6.22E+13 | 1.78E+13 | 3.5 | 900 | 44 | 0 | 0.01 | 2 |
| 2-28 | 4.00E+13 | 3.27E+13 | 7.27E+12 | 4.5 | 910 | 43 | 0 | 0.03 | 2 |
| 2-29 | 3.60E+13 | 3.05E+13 | 5.54E+12 | 5.5 | 905 | 42 | 0.01 | 0.06 | 2 |

TABLE 6-continued

| No | Number density of precipitates (a = particle size; nm) 5 ≤ a ≤ 50 Number of particles/mm³ | 5 ≤ a < 10 | 10 ≤ a ≤ 50 | Ratio of precipitate | strength YS (MPa) | electrical conductivity EC (% IACS) | initial anti setting (mm) | repetitive anti setting (mm) | bendability |
|---|---|---|---|---|---|---|---|---|---|
| 2-30 | 4.00E+13 | 3.20E+13 | 8.00E+12 | 4 | 910 | 43 | 0 | 0.02 | 2 |
| 2-31 | 4.00E+13 | 3.33E+13 | 6.67E+12 | 5 | 900 | 42 | 0 | 0.04 | 2 |
| 2-32 | 8.00E+13 | 6.22E+13 | 1.78E+13 | 3.5 | 910 | 45 | 0 | 0.01 | 2 |
| 2-33 | 4.00E+13 | 3.27E+13 | 7.27E+12 | 4.5 | 920 | 43 | 0 | 0.03 | 2 |
| 2-34 | 3.60E+13 | 3.05E+13 | 5.54E+12 | 5.5 | 915 | 43 | 0.01 | 0.06 | 2 |
| 2-35 | 4.00E+13 | 3.20E+13 | 8.00E+12 | 4 | 920 | 44 | 0 | 0.02 | 2 |
| 2-36 | 4.00E+13 | 3.33E+13 | 6.67E+12 | 5 | 910 | 43 | 0 | 0.04 | 2 |
| 2-37 | 8.00E+12 | 6.55E+12 | 1.45E+12 | 4.5 | 850 | 46 | 0.01 | 0.05 | 1.5 |
| 2-38 | 8.00E+12 | 6.40E+12 | 1.60E+12 | 4 | 860 | 47 | 0.01 | 0.04 | 1.5 |
| 2-39 | 1.20E+13 | 9.82E+12 | 2.18E+12 | 4.5 | 875 | 44 | 0 | 0.04 | 1.5 |
| 2-40 | 1.20E+13 | 9.82E+12 | 2.18E+12 | 4.5 | 885 | 45 | 0.01 | 0.05 | 2 |
| 2-41 | 8.00E+12 | 6.55E+12 | 1.45E+12 | 4.5 | 840 | 46 | 0.02 | 0.06 | 0.5 |
| 2-42 | 1.60E+13 | 1.24E+13 | 3.56E+12 | 3.5 | 880 | 45 | 0 | 0.02 | 1.5 |
| 2-43 | 1.60E+13 | 1.24E+13 | 3.56E+12 | 3.5 | 900 | 43 | 0 | 0.01 | 2 |
| 2-44 | 8.00E+12 | 6.55E+12 | 1.45E+12 | 4.5 | 860 | 44 | 0 | 0.04 | 1.5 |
| 2-45 | 8.00E+12 | 6.55E+12 | 1.45E+12 | 4.5 | 860 | 43 | 0 | 0.04 | 1.5 |
| 2-46 | 1.20E+13 | 9.60E+12 | 2.40E+12 | 4 | 850 | 46 | 0.01 | 0.04 | 1.5 |
| 2-47 | 8.00E+12 | 6.40E+12 | 1.60E+12 | 4 | 870 | 45 | 0 | 0.03 | 1.5 |
| 2-48 | 8.00E+12 | 6.55E+12 | 1.45E+12 | 4.5 | 870 | 44 | 0.01 | 0.05 | 1.5 |
| 2-49 | 1.20E+13 | 9.60E+12 | 2.40E+12 | 4 | 860 | 47 | 0 | 0.04 | 1.5 |
| 2-50 | 8.00E+12 | 6.55E+12 | 1.45E+12 | 4.5 | 860 | 42 | 0.01 | 0.05 | 1.5 |
| 2-51 | 8.00E+12 | 6.40E+12 | 1.60E+12 | 4 | 870 | 43 | 0 | 0.04 | 1.5 |
| 2-52 | 8.00E+13 | 6.55E+13 | 1.45E+13 | 4.5 | 930 | 40 | 0 | 0.03 | 2 |
| 2-53 | 8.00E+13 | 6.49E+13 | 1.51E+13 | 4.3 | 935 | 41 | 0 | 0.03 | 2 |
| 2-54 | 8.00E+12 | 6.52E+12 | 1.48E+12 | 4.4 | 865 | 45 | 0.01 | 0.05 | 1.5 |

5. Comparative Example (Ni Added)

Each of copper alloys having compositions listed in Table 7 was melted at 1300° C. in a high-frequency melting furnace, and cast into an ingot of 30 mm thick. The ingot was then heated at 1000° C. for 3 hours, hot rolled down to 10 mm thick while setting the finish temperature (hot rolling termination temperature) to 900° C., and then quenched to room temperature quickly after the hot rolling by water cooling. Next, the surface was scalped so as to remove scales and thereby to reduce the thickness down to 9 mm, and then cold rolled into a sheet of 0.15 mm thick. The sheet was then subjected to solution treatment under the given temperature and time, and then quenched quickly after the solution treatment by water cooling. The sheet was then subjected to the first ageing in an inert atmosphere under the given temperature and time, cold rolled at each rolling reduction, and finally subjected to the second ageing in an inert atmosphere under the given temperature and time. Each specimen was manufactured in this way.

TABLE 7

| No | Composition (mass %) Ni | Co | Si | Cr | others | Solution treatment temp. (° C.) | time (s) | 1st ageing temp. (° C.) | time (hr) | Cold rolling Rolling reduction (%) | 2nd ageing temp. (° C.) | time (hr) |
|---|---|---|---|---|---|---|---|---|---|---|---|---|
| 2-55 | 1.8 | 1.0 | 0.65 | | | 1000 | 60 | 375 | 24 | 40 | 275 | 48 |
| 2-56 | 1.8 | 1.0 | 0.65 | | | 1000 | 60 | 450 | 9 | 40 | 275 | 48 |
| 2-57 | 1.8 | 1.0 | 0.65 | | | 1000 | 60 | 525 | 3 | 40 | 275 | 48 |
| 2-58 | 1.8 | 1.0 | 0.65 | | | 1000 | 60 | 375 | 24 | 40 | 350 | 12 |
| 2-59 | 1.8 | 1.0 | 0.65 | | | 1000 | 60 | 525 | 3 | 40 | 350 | 12 |
| 2-60 | 1.8 | 1.0 | 0.65 | | | 1000 | 60 | 375 | 24 | 40 | 450 | 3 |
| 2-61 | 1.8 | 1.0 | 0.65 | | | 1000 | 60 | 450 | 9 | 40 | 450 | 3 |
| 2-62 | 1.8 | 1.0 | 0.65 | | | 1000 | 60 | 525 | 3 | 40 | 450 | 3 |
| 2-63 | 1.8 | 1.0 | 0.65 | | | 1000 | 60 | 550 | 3 | 40 | 350 | 12 |
| 2-64 | 1.8 | 1.0 | 0.65 | | | 1000 | 60 | 480 | 48 | 40 | 350 | 48 |
| 2-65 | 1.8 | 1.0 | 0.65 | 0.2 | | 1000 | 60 | 375 | 24 | 40 | 275 | 48 |
| 2-66 | 1.8 | 1.0 | 0.65 | 0.2 | | 1000 | 60 | 450 | 9 | 40 | 275 | 48 |
| 2-67 | 1.8 | 1.0 | 0.65 | 0.2 | | 1000 | 60 | 525 | 3 | 40 | 275 | 48 |
| 2-68 | 1.8 | 1.0 | 0.65 | 0.2 | | 1000 | 60 | 375 | 24 | 40 | 350 | 12 |
| 2-69 | 1.8 | 1.0 | 0.65 | 0.2 | | 1000 | 60 | 525 | 3 | 40 | 350 | 12 |
| 2-70 | 1.8 | 1.0 | 0.65 | 0.2 | | 1000 | 60 | 375 | 24 | 40 | 450 | 3 |
| 2-71 | 1.8 | 1.0 | 0.65 | 0.2 | | 1000 | 60 | 450 | 9 | 40 | 450 | 3 |
| 2-72 | 1.8 | 1.0 | 0.65 | 0.2 | | 1000 | 60 | 525 | 3 | 40 | 450 | 3 |
| 2-73 | 1.8 | 1.0 | 0.65 | 0.2 | | 1000 | 60 | 550 | 3 | 40 | 350 | 12 |
| 2-74 | 1.8 | 1.0 | 0.65 | 0.2 | | 1000 | 60 | 480 | 48 | 40 | 350 | 48 |
| 2-75 | 1.8 | 1.0 | 0.65 | | 0.1Mg | 1000 | 60 | 375 | 24 | 40 | 275 | 48 |
| 2-76 | 1.8 | 1.0 | 0.65 | | 0.1Mg | 1000 | 60 | 525 | 3 | 40 | 275 | 48 |
| 2-77 | 1.8 | 1.0 | 0.65 | | 0.1Mg | 1000 | 60 | 375 | 24 | 40 | 450 | 3 |
| 2-78 | 1.8 | 1.0 | 0.65 | | 0.1Mg | 1000 | 60 | 525 | 3 | 40 | 450 | 3 |

TABLE 7-continued

| | Composition (mass %) | | | | | Solution treatment | | 1st ageing | | Cold rolling | 2nd ageing | |
|---|---|---|---|---|---|---|---|---|---|---|---|---|
| | | | | | | temp. | time | temp. | time | Rolling reduction | temp. | time |
| No | Ni | Co | Si | Cr | others | (° C.) | (s) | (° C.) | (hr) | (%) | (° C.) | (hr) |
| 2-79 | 1.8 | 1.0 | 0.65 | 0.2 | 0.1Mg | 1000 | 60 | 375 | 24 | 40 | 275 | 48 |
| 2-80 | 1.8 | 1.0 | 0.65 | 0.2 | 0.1Mg | 1000 | 60 | 525 | 3 | 40 | 275 | 48 |
| 2-81 | 1.8 | 1.0 | 0.65 | 0.2 | 0.1Mg | 1000 | 60 | 375 | 24 | 40 | 450 | 3 |
| 2-82 | 1.8 | 1.0 | 0.65 | 0.2 | 0.1Mg | 1000 | 60 | 525 | 3 | 40 | 450 | 3 |
| 2-83 | 1.8 | 1.0 | 0.65 | | | 1000 | 60 | 480 | 3 | 5 | 350 | 12 |
| 2-84 | 1.8 | 1.0 | 0.65 | 0.2 | | 1000 | 60 | 480 | 3 | 5 | 350 | 12 |
| 2-85 | 1.8 | 1.0 | 0.65 | | | 1000 | 60 | 480 | 3 | 60 | 350 | 12 |
| 2-86 | 1.8 | 1.0 | 0.65 | 0.2 | | 1000 | 60 | 480 | 3 | 60 | 350 | 12 |
| 2-87 | 1.67 | 1.06 | 0.62 | | 0.08Mg | 950 | 60 | 525 | 3 | 25 | 400 | 3 |
| 2-88 | 2.32 | 1.59 | 0.78 | | 0.1Mg | 950 | 60 | 525 | 3 | 25 | 400 | 3 |
| 2-89 | 1.8 | 1.0 | 0.65 | 0.2 | | 1000 | 60 | 480 | 3 | 40 | — | — |
| 2-90 | 1.8 | 1.0 | 0.65 | 0.2 | | 1000 | 60 | 480 | 3 | — | — | — |
| 2-91 | 1.8 | 1.0 | 0.65 | | | 1000 | 60 | 480 | 3 | 40 | 325 | 1 |
| 2-92 | 1.8 | 1.0 | 0.65 | | | 1000 | 60 | 480 | 3 | 40 | 325 | 48 |

The thus obtained specimens were measured with respect to the number density of second phase particles, and alloy characteristics similarly as described in the above. Results of measurement were shown in Table 8.

TABLE 8

| | Number density of precipitates (a = particle size; nm) | | | | strength | electrical conductivity | initial | repetitive | |
|---|---|---|---|---|---|---|---|---|---|
| No | $5 \leq a \leq 50$ Number of particles/mm$^3$ | $5 \leq a < 10$ | $10 \leq a \leq 50$ | Ratio of precipitate | YS (MPa) | EC (% IACS) | anti setting (mm) | anti setting (mm) | bendability |
| 2-55 | 3.20E+11 | 2.91E+11 | 2.91E+10 | 1.0 | 700 | 33 | 0.13 | 0.25 | 0.5 |
| 2-56 | 3.20E+12 | 2.29E+12 | 9.14E+11 | 2.5 | 790 | 40 | 0.1 | 0.15 | 1 |
| 2-57 | 2.80E+12 | 1.87E+12 | 9.33E+11 | 2 | 740 | 47 | 0.12 | 0.18 | 0.5 |
| 2-58 | 3.60E+11 | 3.20E+11 | 4.00E+10 | 8 | 720 | 35 | 0.12 | 0.23 | 0.5 |
| 2-59 | 3.20E+12 | 2.80E+12 | 4.00E+11 | 7 | 720 | 49 | 0.11 | 0.2 | 0.5 |
| 2-60 | 4.00E+12 | 2.00E+12 | 2.00E+12 | 1 | 770 | 40 | 0.1 | 0.15 | 0.75 |
| 2-61 | 1.20E+13 | 4.00E+12 | 8.00E+12 | 0.5 | 760 | 44 | 0.1 | 0.15 | 0.75 |
| 2-62 | 2.40E+11 | 2.18E+10 | 2.18E+11 | 0.1 | 660 | 53 | 0.18 | 0.3 | 0.25 |
| 2-63 | 2.00E+11 | 1.69E+11 | 3.08E+10 | 5.5 | 660 | 52 | 0.16 | 0.3 | 0.25 |
| 2-64 | 9.00E+11 | 6.00E+11 | 3.00E+11 | 2 | 740 | 48 | 0.11 | 0.18 | 0.5 |
| 2-65 | 3.20E+11 | 2.91E+11 | 2.91E+10 | 1.0 | 710 | 34 | 0.13 | 0.24 | 0.5 |
| 2-66 | 3.20E+12 | 2.29E+12 | 9.14E+11 | 2.5 | 795 | 41 | 0.11 | 0.15 | 1 |
| 2-67 | 2.80E+12 | 1.87E+12 | 9.33E+11 | 2 | 750 | 48 | 0.12 | 0.18 | 0.5 |
| 2-68 | 3.60E+11 | 3.20E+11 | 4.00E+10 | 8 | 730 | 36 | 0.12 | 0.22 | 0.5 |
| 2-69 | 3.20E+12 | 2.80E+12 | 4.00E+11 | 7 | 730 | 50 | 0.11 | 0.2 | 0.5 |
| 2-70 | 4.00E+12 | 2.00E+12 | 2.00E+12 | 1 | 780 | 41 | 0.1 | 0.15 | 1 |
| 2-71 | 1.20E+13 | 4.00E+12 | 8.00E+12 | 0.5 | 770 | 39 | 0.11 | 0.15 | 0.75 |
| 2-72 | 2.40E+11 | 2.18E+10 | 2.18E+11 | 0.1 | 670 | 54 | 0.2 | 0.3 | 0.25 |
| 2-73 | 1.00E+11 | 8.57E+10 | 1.43E+10 | 6 | 675 | 54 | 0.15 | 0.28 | 0.25 |
| 2-74 | 9.90E+11 | 6.60E+11 | 3.30E+11 | 2 | 750 | 49 | 0.12 | 0.17 | 0.5 |
| 2-75 | 3.20E+11 | 2.90E+11 | 3.05E+10 | 9.5 | 720 | 31 | 0.13 | 0.23 | 0.5 |
| 2-76 | 3.20E+12 | 2.13E+12 | 1.07E+12 | 2 | 760 | 45 | 0.11 | 0.18 | 0.75 |
| 2-77 | 4.00E+12 | 2.00E+12 | 2.00E+12 | 1 | 790 | 38 | 0.1 | 0.14 | 1 |
| 2-78 | 2.40E+11 | 2.18E+10 | 2.18E+11 | 0.1 | 680 | 51 | 0.17 | 0.28 | 0.25 |
| 2-79 | 3.20E+11 | 2.91E+11 | 2.91E+10 | 1.0 | 730 | 32 | 0.12 | 0.22 | 0.5 |
| 2-80 | 3.20E+12 | 2.13E+12 | 1.07E+12 | 2 | 770 | 46 | 0.09 | 0.13 | 0.75 |
| 2-81 | 4.00E+12 | 2.00E+12 | 2.00E+12 | 1 | 800 | 52 | 0.11 | 0.16 | 1 |
| 2-82 | 2.40E+11 | 2.18E+10 | 2.18E+11 | 0.1 | 690 | 33 | 0.11 | 0.2 | 0.25 |
| 2-83 | 4.00E+12 | 2.67E+12 | 1.33E+12 | 2 | 740 | 44 | 0.1 | 0.15 | 0 |
| 2-84 | 4.00E+12 | 2.86E+12 | 1.14E+12 | 2.5 | 750 | 45 | 0.1 | 0.15 | 0 |
| 2-85 | 8.00E+12 | 6.77E+12 | 1.23E+12 | 5.5 | 860 | 46 | 0.01 | 0.06 | 4 |
| 2-86 | 8.00E+12 | 6.77E+12 | 1.23E+12 | 5.5 | 870 | 46 | 0.01 | 0.05 | 4 |
| 2-87 | 3.00E+11 | 5.00E+10 | 2.50E+11 | 0.2 | 768 | 43 | 0.14 | 0.18 | 0.25 |
| 2-88 | 6.00E+11 | 1.00E+11 | 5.00E+11 | 0.2 | 774 | 40 | 0.11 | 0.15 | 0.5 |
| 2-89 | 3.61E+10 | 2.18E+10 | 1.43E+10 | 1.5 | 820 | 43 | 0.08 | 0.13 | 1.5 |
| 2-90 | 1.48E+13 | 6.77E+12 | 8.00E+12 | 0.8 | 640 | 44 | 0.24 | 0.32 | 0 |
| 2-91 | 3.20E+12 | 2.13E+12 | 1.07E+12 | 2 | 810 | 44 | 0.08 | 0.12 | 1.5 |
| 2-92 | 4.00E+12 | 2.86E+12 | 1.14E+12 | 2.5 | 800 | 41 | 0.11 | 0.15 | 1.5 |

6. Discussion

<No. 2-1 to 2-54>

All of the strength, electrical conductivity, anti-setting property and bendability were found to be excellent, by virtue of appropriate values of number density of second phase particles.

<No. 2-55, 2-65, 2-75, 2-79>

The second phase particles having particle sizes of 5 nm or larger and 50 nm or smaller were generally found to be insufficient, due to low temperature settings in the first ageing and in the second ageing.

<No. 2-56, 2-66>

Ratios of the second phase particles having particle sizes of 5 nm or larger and smaller than 10 nm were found to be small, due to low temperature settings in the second ageing.

<No. 2-57, 2-67, 2-76, 2-80>

Ratios of the second phase particles having particle sizes of 5 nm or larger and smaller than 10 nm were found to be small, due to high temperature settings in the first ageing, and low temperature settings in the second ageing.

<No. 2-58, 2-68>

The second phase particles having particle sizes of 5 nm or larger and 50 nm or smaller were generally found to be small, due to low temperature settings in the first ageing.

<No. 2-59, 2-63, 2-69, 2-73>

The second phase particles having particle sizes of 5 nm or larger and 50 nm or smaller were generally found to be insufficient, or, the second phase particles having particle sizes of 10 nm or larger and 50 nm or smaller and the second phase particles having particle sizes of 5 nm or larger and smaller than 10 nm were found to be unbalanced, due to high temperature settings in the first ageing.

<No. 2-60, 2-70, 2-77, 2-81>

The second phase particles having particle sizes of 10 nm or larger and 50 nm or smaller, and the second phase particles having particle sizes of 5 nm or larger and smaller than 10 nm were found to be unbalanced, due to low temperature settings in the first ageing, and due to high temperature settings in the second ageing.

<No. 2-61, 2-71>

Ratios of the second phase particles having particle sizes of 5 nm or larger and smaller than 10 nm were found to be small, due to high temperature settings in the second ageing.

<No. 2-62, 2-72, 2-78, 2-82>

The second phase particles having particle sizes of 5 nm or larger and 50 nm or smaller specified by the present invention were generally found to be insufficient, due to high temperature settings in the first ageing and in the second ageing, and generally excessive growth of the second phase particles as a consequence.

<No. 2-64, 2-74>

The second phase particles having particle sizes of 5 nm or larger and smaller than 10 nm were found to be insufficient, due to long time settings in the first ageing and in the second ageing.

<No. 2-83, 2-84>

Ratios of the second phase particles having particle sizes of 5 nm or larger and smaller than 10 nm were found to be small, due to small values of rolling reduction of cold rolling between the first ageing and in the second ageing, and due to weakened effects of the second ageing as a consequence.

<No. 2-85, 2-86>

Although Nos. 2-85 and 2-86 were inventive examples, the bendability values were found to be lowered, due to large values of rolling reduction of cold rolling between the first ageing and the second ageing, and due to increased effects of the second ageing as a consequence.

<No. 2-87, 2-88>

Ratios of the second phase particles having particle sizes of 5 nm or larger and smaller than 10 nm were found to be small, due to high temperature settings in the first ageing.

<No. 2-89, 2-90>

Ratios of the second phase particles having particle sizes of 5 nm or larger and smaller than 10 nm were found to be small, due to omission of the second ageing.

<No. 2-91>

Ratio of the second phase particles having particle sizes of 5 nm or larger and smaller than 10 nm was found to be small, due to shorter ageing time in the second ageing as compared with the first ageing.

<No. 2-92>

Ratio of the second phase particles having particle sizes of 5 nm or larger and smaller than 10 nm was found to be small, due to too long ageing time in the second ageing as compared with the first ageing.

Explanation of the Marks

11 specimen
12 knife edge
13 gage length
14 vise
15 stroke
16 setting

The invention claimed is:

1. A copper alloy for electronic materials which consists of 0.5 to 3.0% by mass of Co, 0.1 to 1.0% by mass of Si, optionally a maximum of 2.5% by mass of Ni, optionally a maximum of 0.5% by mass of Cr, optionally a maximum of 2.0% by mass in total of one or more selected from the group consisting of Mg, P, As, Sb, Be, B, Mn, Sn, Zr, Al, Fe, Zn and Ag, and the balance of Cu and inevitable impurities wherein out of second phase particles precipitated in the matrix of the alloy a number density of the particles having particle size of 5 nm or larger and 50 nm or smaller is $1\times10^{12}$ to $1\times10^{14}$ particles/mm$^3$, and a ratio of the number density of particles having particle size of 5 nm or larger and smaller than 10 nm relative to the number density of particles having particle size of 10 nm or larger and 50 nm or smaller is 3 to 6.

2. The copper alloy for electronic materials according to claim 1, wherein the number density of second phase particles having particle sizes of 5 nm or larger and smaller than 10 nm is $2\times10^{12}$ to $7\times10^{13}$, and the number density of second phase particles having particle sizes of 10 nm or larger and 50 nm or smaller is $3\times10^{11}$ to $2\times10^{13}$.

3. The copper alloy for electronic materials according to claim 1, having an MBR/t value of 2.0 or smaller, the value being defined by a ratio of minimum bend radius (MBR) not causative of crack to thickness of specimen (t) when tested by a W-bend test in the bad-way direction, in accordance with JIS H3130.

4. The copper alloy for electronic materials according to claim 1, further containing a maximum of 2.5% by mass of Ni.

5. The copper alloy for electronic materials according to claim 1, further containing a maximum of 0.5% by mass of Cr.

6. The copper alloy for electronic materials according to claim 1, further containing a maximum of 2.0% by mass in total of one or more selected from the group consisting of Mg, P, As, Sb, Be, B, Mn, Sn, Zr, Al, Fe, Zn and Ag.

7. A method of manufacturing a copper alloy for electronic materials according to claim 1, comprising the sequential steps of:

(1) melting and casting of an ingot represented by any one composition according to claim 1;

(2) heating the material from step (1) at 950° C. or above and 1050° C. or below for one hour or more, followed by hot rolling;

(3) optionally cold rolling the material from step (2);

(4) performing solution treatment while heating the material from step (3) at 850° C. or above and 1050° C. or below;

(5) first ageing while heating the material from step (4) at 400° C. or above and 600° C. or below for 1 to 12 hours, where the temperature is adjusted to 400° C. or above and 500° C. or below for an ingot containing 1.0 to 2.5% by mass of Ni;

(6) cold rolling the material from step (5) at a rolling reduction of 10% or more; and (7) second ageing while heating the material from step (6) at 300° C. or above and 400° C. or below for 3 to 36 hours, the time of heating being 3 to 10 times as long as that in the first ageing;

wherein all steps of said method take place in the order indicated.

8. The method of manufacturing a copper alloy for electronic materials according to claim 7, wherein the rolling reduction in cold rolling step (6) is 10 to 50%.

9. A wrought copper product made of a copper alloy for electronic materials according to claim 1.

10. An electronic component comprising a copper alloy for electronic materials according to claim 1.

* * * * *